US008931323B2

(12) United States Patent
Kaminsky

(10) Patent No.: US 8,931,323 B2
(45) Date of Patent: Jan. 13, 2015

(54) MULTI-LAYERED PIPES FOR USE IN THE HYDROCARBON INDUSTRY, METHODS OF FORMING THE SAME, AND MACHINES FOR FORMING THE SAME

(75) Inventor: Robert D. Kaminsky, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 623 days.

(21) Appl. No.: 12/965,373

(22) Filed: Dec. 10, 2010

(65) Prior Publication Data

US 2011/0179849 A1 Jul. 28, 2011

Related U.S. Application Data

(60) Provisional application No. 61/297,568, filed on Jan. 22, 2010.

(51) Int. Cl.
*B21C 37/06* (2006.01)
*B21C 37/09* (2006.01)

(52) U.S. Cl.
CPC ..... *B21C 37/09* (2013.01)
USPC ..... 72/368; 72/48; 72/52; 72/363

(58) Field of Classification Search
CPC ..... B21C 37/06; B21C 37/08; B21C 37/083; B21C 37/154
USPC ..... 72/48, 51, 52, 95, 98, 166, 169, 363, 72/367.1, 368, 369; 228/147, 148, 149, 228/150; 138/143, 151, 170, 171
See application file for complete search history.

(56) References Cited

U.S. PATENT DOCUMENTS 611,222 A 9/1898 Ries
1,665,651 A 4/1928 Harris
1,915,257 A 6/1933 Breitenbach
(Continued)

FOREIGN PATENT DOCUMENTS

DE 3044003 C2 7/1983
EP 523361 * 6/1992 ..... B21D 15/10

OTHER PUBLICATIONS

Nikitina, L. A., "New in Science and Technology: Status and Prospects for the Manufacture of Multilayered and Bimetallic Metal Products", Metallurgist, Aug. 1998, pp. 297-301, v. 42, No. 8, Plenum Publishing Corporation.
(Continued)

*Primary Examiner* — Edward Tolan
(74) *Attorney, Agent, or Firm* — ExxonMobil Upstream Research Company—Law Department

(57) ABSTRACT

Multi-layered pipes, machines for forming multi-layered pipes, and methods of forming multi-layered pipes, such as for use in the hydrocarbon industry as may form high-pressure pipelines including forming an inner metal tube from a first metal stock, and while forming the inner metal tube, forming at least a second metal tube around the inner tube from at least a second metal stock. In some methods, sheet metal is bent to form tubes having seams, which are welded while the tubes are being formed. Some methods are performed proximate to an installation site for the multi-layered pipe, such as a hydrocarbon extraction or transportation site. Some methods are performed on a vehicle and proximate to an installation site.

34 Claims, 3 Drawing Sheets

(56) References Cited

U.S. PATENT DOCUMENTS

| | | | | | |
|---|---|---|---|---|---|
| 1,925,118 | A | | 9/1933 | Stresau | |
| 1,954,160 | A | | 4/1934 | Wheeler | |
| 2,072,273 | A | | 3/1937 | Obert | |
| 2,209,402 | A | | 7/1940 | Kepler | |
| 2,234,450 | A | * | 3/1941 | Quarnstrom | 228/148 |
| 2,255,472 | A | * | 9/1941 | Quarnstrom | 138/142 |
| 2,377,908 | A | | 6/1945 | Slaughter | |
| 2,803,730 | A | | 8/1957 | Kinghorn | |
| 3,069,763 | A | | 12/1962 | Reynolds | |
| 3,085,146 | A | | 4/1963 | Ferreruela | |
| 3,091,848 | A | * | 6/1963 | Frank | 228/150 |
| 3,149,513 | A | | 9/1964 | Dollens | |
| 3,327,383 | A | * | 6/1967 | Reed | 228/130 |
| 3,425,380 | A | | 2/1969 | Krainer et al. | |
| 3,478,784 | A | | 11/1969 | Woelfer et al. | |
| 3,610,290 | A | | 10/1971 | Anderson | |
| 3,712,100 | A | * | 1/1973 | Key et al. | 72/161 |
| 3,941,296 | A | * | 3/1976 | Ziemek | 228/148 |
| 3,948,292 | A | | 4/1976 | Goto et al. | |
| 3,982,402 | A | * | 9/1976 | Lang et al. | 405/168.3 |
| 4,083,484 | A | * | 4/1978 | Polizzano et al. | 228/130 |
| 4,160,312 | A | | 7/1979 | Nyssen | |
| 4,161,811 | A | * | 7/1979 | Nyssen | 29/429 |
| 4,244,482 | A | | 1/1981 | Baumgart et al. | |
| 4,249,406 | A | | 2/1981 | Anderson | |
| 4,403,491 | A | | 9/1983 | Wassen et al. | |
| 4,784,311 | A | | 11/1988 | Sugao | |
| 5,011,064 | A | | 4/1991 | Fuss | |
| 5,097,585 | A | | 3/1992 | Klemm | |
| 5,620,805 | A | * | 4/1997 | Ogawa et al. | 428/683 |
| 5,722,463 | A | * | 3/1998 | Smyth et al. | 138/170 |
| 5,755,266 | A | | 5/1998 | Aanonsen et al. | |
| 5,958,602 | A | | 9/1999 | Usui | |
| 6,639,194 | B2 | | 10/2003 | Pascal et al. | |
| 6,668,455 | B2 | * | 12/2003 | Duvall et al. | 29/890.141 |
| 6,904,939 | B2 | * | 6/2005 | Jung et al. | 138/135 |
| 7,226,243 | B2 | * | 6/2007 | Lee et al. | 405/154.1 |
| 8,091,588 | B2 | * | 1/2012 | Burke, II | 138/143 |
| 8,117,882 | B2 | * | 2/2012 | Berg | 72/367.1 |
| 8,235,628 | B2 | * | 8/2012 | Lamison | 405/168.3 |
| 8,309,193 | B2 | * | 11/2012 | Emad et al. | 428/36.91 |
| 2005/0152733 | A1 | | 7/2005 | Patel | |
| 2010/0012217 | A1 | * | 1/2010 | Herbst | 138/143 |
| 2011/0120585 | A1 | * | 5/2011 | Hur et al. | 138/140 |

OTHER PUBLICATIONS

Yurkin, V. S., "New Resource-Saving Technique for Production of Multilayer Metal Sheets and Tubes", Metallurgist, Mar. 1996, pp. 39-40, v. 40, Nos. 3-4, Plenum Publishing Corporation.

* cited by examiner

MULTI-LAYERED PIPES FOR USE IN THE HYDROCARBON INDUSTRY, METHODS OF FORMING THE SAME, AND MACHINES FOR FORMING THE SAME

CROSS REFERENCE TO RELATED APPLICATIONS

This application claims the benefit of U. S. Provisional Application No. 61/297,568 filed Jan. 22, 2010.

FIELD OF THE DISCLOSURE

The present disclosure is directed generally to multi-layered pipes, methods of forming multi-layered pipes, and machines for forming multi-layered pipes. The multi-layered pipes may be used in the hydrocarbon industry, such as in the extraction and/or transportation of hydrocarbons.

BACKGROUND OF THE DISCLOSURES

In the hydrocarbon (oil and gas) industry, metal pipes, or pipelines, are used in a variety of situations, from the drilling and extraction (production) of hydrocarbons to the transportation of hydrocarbons. For example, in the production of hydrocarbons, metal pipes may be positioned within wellbores for the extraction of hydrocarbons from a subterranean reservoir. Additionally or alternatively, metal pipes may be positioned within wellbores for the delivery of fluids to a subterranean reservoir, for example, to displace the hydrocarbons being extracted from the subterranean reservoir. Extraction sites may be on land and/or offshore. Once extracted, the hydrocarbons may be transported over distances—sometimes very long distance—through pipes. Such pipes used to transport hydrocarbons, which may be referred to as pipelines due to their length, may be subterranean, may be above-the-ground, and/or may be underwater.

Long pipes, or pipelines, used in the hydrocarbon industry, whether installed subterranean, aboveground, and/or underwater, are typically first manufactured in relatively short segments (e.g., 5-25 meters in length) at a manufacturing facility, which may be hundreds or thousands of kilometers, or even continents, away from an eventual installation site for the pipe, or pipeline, such as a hydrocarbon production or transportation site. These segments are then transported to the installation site, for example, by truck, rail, and/or ship, and typically are then manually welded together on-site to form a long pipeline. In some situations, the final pipeline may be hundreds, or even thousands, of kilometers long, with such pipelines requiring 40-200 or more separately welded joints per kilometer of length, often amounting to tens of thousands of individual welded joints for a single pipeline. The transportation and welding requirements may be exacerbated when the pipes are to be transported to and joined to form a pipeline in arctic and other regions where environmental conditions limit the time periods in which these operations may be performed. Added difficulties of welding and pipe joint transportation may occur when large-diameter pipes (such as pipes having diameters of at least 0.5 meters) or thick wall pipes (such as pipes having walls with thicknesses of at least 2 cm) are required.

Extruded plastic pipes and fiber-wrapped pipes have been proposed as methods to continuously form pipe, with illustrative examples of such pipes and formation methods being disclosed in U.S. Pat. Nos. 2,377,908 and 3,948,292. However, extruded pipes are typically not suitable for high pressure. Fiber-wrapped pipes are complex to manufacture, especially outside of a specialty construction facility. Moreover, both types of pipe are difficult join up with existing metal pipe segments since neither plastic pipes nor fiber-wrapped pipes are weldable. Also, quality assurance may be difficult using conventional and/or suitable in-field methods, which tend to be designed for use with metal pipes. Additionally, fiber-winding methods are generally unwieldy for large diameter, long pipe segments since the winding equipment needs to rotate around the pipe segment or the pipe segment itself needs to be rotated.

Methods have been disclosed in the past for making multilayer-walled pipes and pressure vessels. An early example is disclosed in U.S. Pat. No. 2,072,273, which describes a method of making a pressure vessel shell. The method includes forming a plurality of metal sheets; superimposing one sheet upon the other; applying substantially uniform pressure both externally and internally of the superimposed sheets to hold them tightly together; and joining the sheets together along their respective seams while such pressure is maintained. Another example is disclosed in U.S. Pat. No. 1,925,118, which describes a pressure vessel having side walls that comprise a plurality of concentric tubular members that form a laminated structure. The individual members of the pressure vessel are constituted by a sheet metal blank that is shaped into tubular form and fused at its meeting edges with the adjacent tubular member. Additional illustrative, non-exclusive examples of laminated metallic pipe and pressure vessel constructions are disclosed in U.S. Pat. Nos. 3,149,513, 3,610,290, 4,244,482, 5,097,585, 5,755,266, 2,209,402, and 3,425,380.

SUMMARY OF THE DISCLOSURE

The present disclosure is directed to multi-layered pipes, to methods of forming the same, and to machines for forming the same. The multi-layered pipes may be used in the hydrocarbon industry, such as in the extraction and/or transportation of hydrocarbons. Multi-layered pipes according to the present disclosure include at least an inner metal tube and a second metal tube formed around the inner metal tube. Multi-layered pipes according to the present disclosure optionally may include at least a third metal tube formed around the second metal tube, and further optionally may include at least a fourth (or more) metal tube formed around the third metal tube.

Machines according to the present disclosure include an inner-tube forming device positioned to receive a first metal stock and configured to form an inner metal tube from the first metal stock, a second-tube forming device positioned to receive a second metal stock and configured to form a second metal tube around the inner metal tube from the second metal stock, and a control system configured to simultaneously feed the first metal stock to the inner-tube forming device and feed the second metal stock to the second-tube forming device. Machines according to the present disclosure optionally may include a third-tube forming device positioned to receive a third metal stock and configured to form a third metal tube around the second metal tube from the third metal stock, and further optionally may include a fourth-tube forming device positioned to receive at least a fourth metal stock and configured to form at least a fourth metal tube around the third metal tube from the fourth metal stock. In such embodiments, the control system may be configured to simultaneously form the third metal stock to the third-tube forming device, and optionally the fourth metal stock to the fourth-tube forming device. In some embodiments, the tube forming devices are coupled to a vehicle, which may be operated proximate to an installation site for the multi-layered pipe, such as a hydrocarbon extraction or transportation site.

Methods according to the present disclosure include forming an inner metal tube from a first metal stock, and while forming the inner metal tube, forming a second metal tube around the inner tube from a second metal stock. The inner metal tube and the second metal tube are thus formed simultaneously. In some methods according to the present disclosure, the methods include simultaneously forming at least a third metal tube, and further optionally at least a fourth metal tube, around the second metal tube while forming the inner and second metal tubes. In some methods, sheet metal or other metal stock is bent to form the metal tubes with seams, and the seams are welded while the tubes are being formed. In some methods, the welds are inspected while the tubes are being formed. Some methods may be performed proximate to an installation site for the multi-layered pipe, such as a hydrocarbon extraction or transportation site. Some methods are performed on a vehicle and proximate to an installation site.

Machines and methods according to the present disclosure may draw the metal stocks from the same or different metal supplies, and optionally may draw the metal stocks from one or more shared, or common supplies, or further optionally may draw each metal stock from a different, respective metal supply.

Of particular interest, although not a requirement of the present disclosure, is the application of the multi-layered pipes, machines, and methods of the present disclosure to improve constructability and to reduce the cost of large-diameter pipes and of thick-walled pipes suitable for long-distance, high-pressure transport of hydrocarbons.

DETAILED DESCRIPTION AND BEST MODE OF THE DISCLOSURE

The present disclosure is directed to multi-layered pipes, for use such as in the extraction and/or transportation of hydrocarbons, to methods of forming such multi-layered pipes, and to machines for forming such multi-layered pipes.

Figure 1:
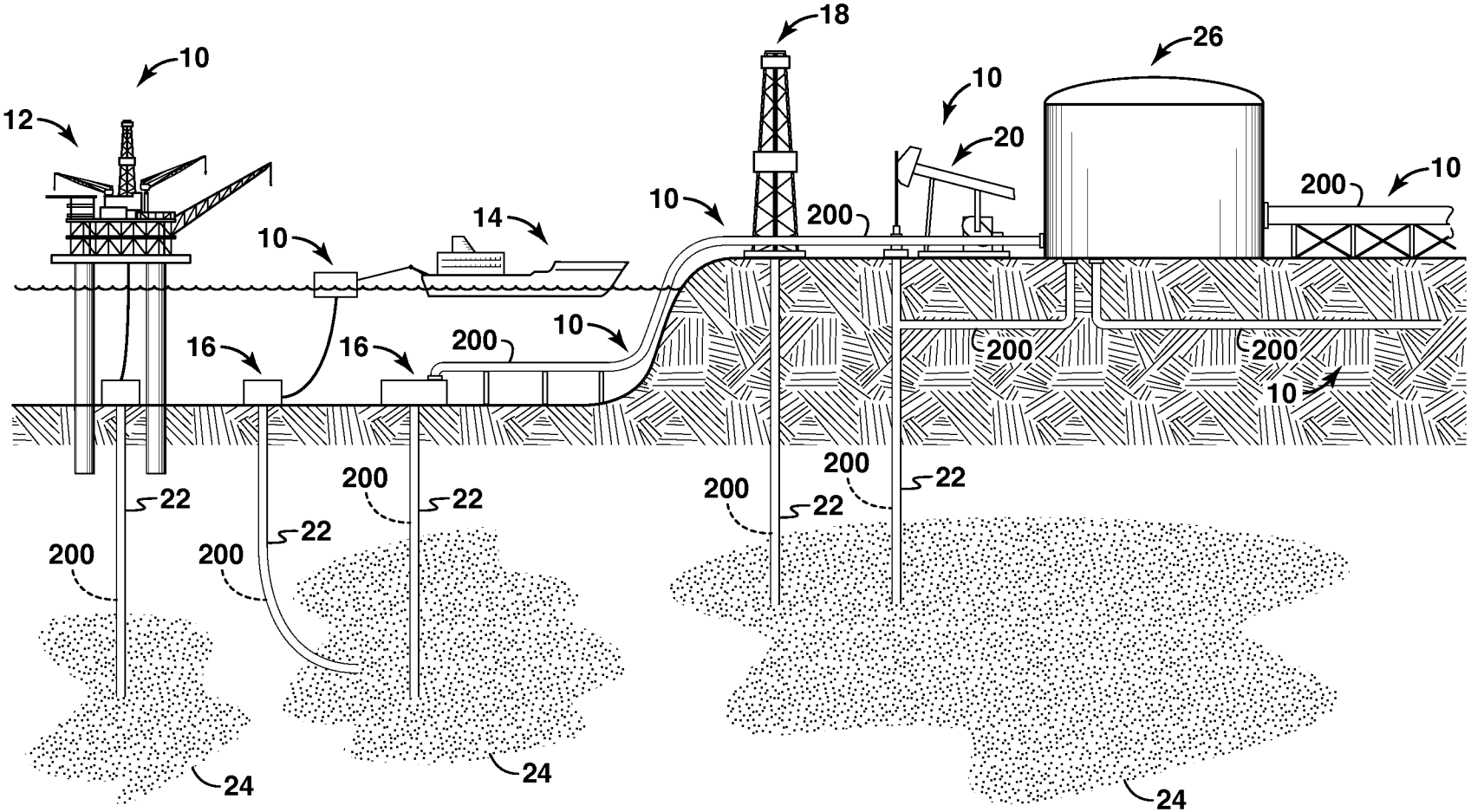
FIG. 1 illustrates illustrative, non-exclusive examples of hydrocarbon production and transportation sites, at which multi-layered pipes according to the present disclosure may be installed, and optionally at which machines and/or methods according to the present disclosure may be utilized.

By way of background, several illustrative, non-exclusive examples of hydrocarbon industry installation sites 10 for multi-layered pipes 200 according to the present disclosure are illustrated in FIG. 1. It should be noted that FIG. 1 and the other figures of the present disclosure are intended to present illustrative, but non-exclusive, examples according to the present disclosure and are not intended to limit the scope of the present disclosure. The figures may not be drawn to scale, as they have been presented to emphasize and illustrate various aspects of the present disclosure. In the figures, the same reference numerals designate like and corresponding, but not necessarily identical, elements through the various drawing figures.

Installation sites 10 for multi-layered pipes 200 according to the present disclosure may be in a variety of locations. As illustrative, non-exclusive examples, multi-layered pipes 200 may be used for the extraction, or production, of hydrocarbons, such as associated with an offshore oil and gas platform 12, a ship 14, an underwater extraction site 16, an onshore drilling facility 18, and/or an onshore extraction facility 20. For example, multi-layered pipes 200 according to the present disclosure may be installed, or positioned, within a wellbore 22, for example, for the extraction of hydrocarbons from a subterranean hydrocarbon reservoir 24 and/or for the delivery of fluids to a subterranean hydrocarbon reservoir to displace the hydrocarbons being extracted. Accordingly, the multiple dashed lead lines for reference numeral 200 associated with wellbores 22, schematically indicate that more than one multi-layered pipe 200 according to the present disclosure may be installed, or positioned, within a single wellbore 22. As used herein, "installation site" refers to a site, or position, at which, or at least near or proximate to, a multi-layered pipe 200 according to the present disclosure will be positioned for use, for example, in the production and/or transportation of hydrocarbons. Accordingly, this term is not intended to refer to a manufacturing facility that is remote from the site where a multi-layered pipe 200 will be ultimately used in the production and/or transportation of hydrocarbons.

Additional illustrative, non-exclusive examples of installation sites for multi-layered pipes 200 according to the present disclosure include sites associated with the transportation of hydrocarbons. As illustrative, non-exclusive examples, FIG. 1 illustrates a multi-layered pipe 200 for transporting hydrocarbons from an underwater extraction site 16 to a hydrocarbon storage facility 26, a subterranean multi-layered pipe 200 for transporting hydrocarbons to and/or from the hydrocarbon storage facility, and an above-the-ground multi-layered pipe 200 for transporting hydrocarbons to and/or from the hydrocarbon storage facility. Other installation sites and applications for multi-layered pipes 200 according to the present disclosure are also within the scope of the present disclosure. Multi-layered pipes 200 also may be referred to as multi-layered pipelines 200, regardless of the ultimate installation site and/or use of the multi-layered pipe, or pipeline.

Figure 2:
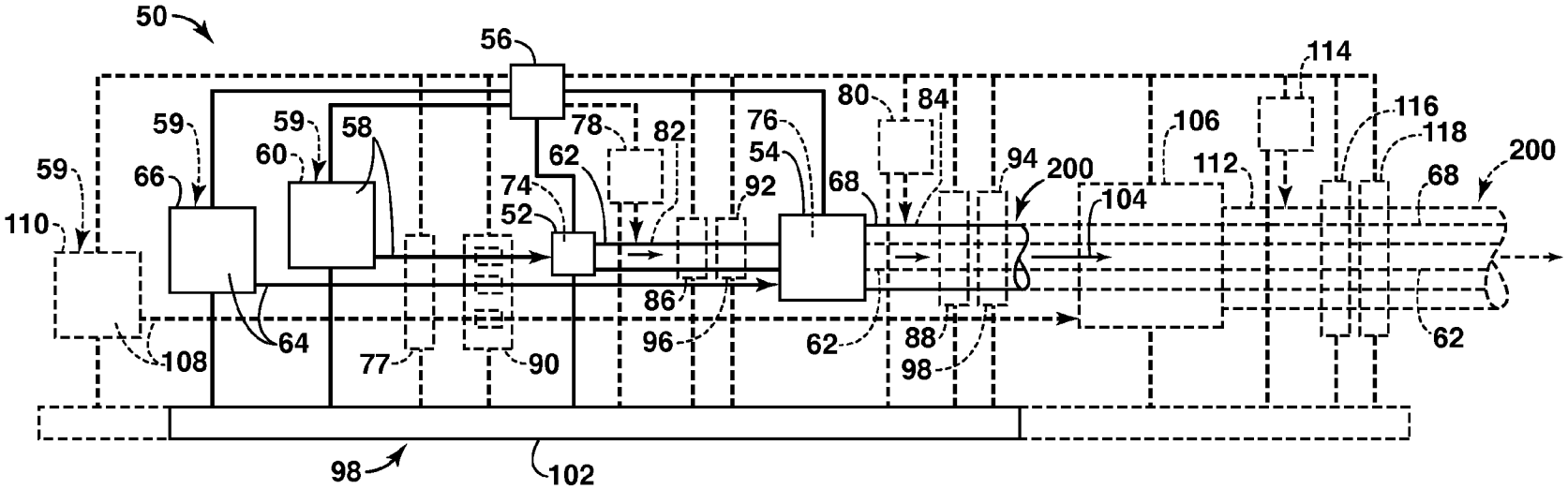
FIG. 2 is a schematic illustration of illustrative, non-exclusive examples of machines according to the present disclosure for forming multi-layered pipes according to the present disclosure.
Figure 4:
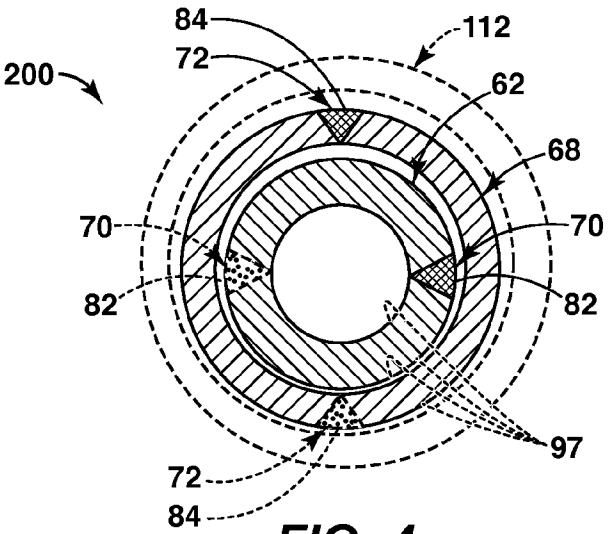
FIG. 4 is another cross-sectional view of illustrative, non-exclusive examples of multi-layered pipes according to the present disclosure.
Figure 3:
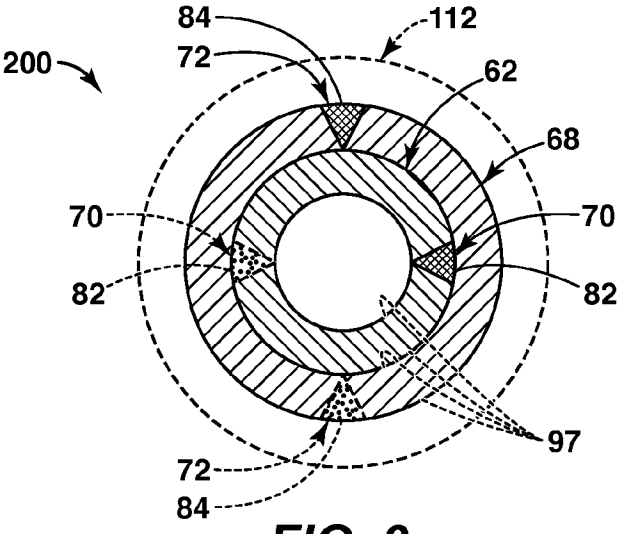
FIG. 3 is a cross-sectional view of illustrative, non-exclusive examples of multi-layered pipes according to the present disclosure.

Turning now to FIGS. 2-4, illustrative, non-exclusive examples of machines according to the present disclosure for forming, or constructing, multi-layered pipes 200 according to the present disclosure are schematically illustrated in FIG. 2 and are indicated generally at 50, and cross-sections of illustrative, non-exclusive examples of multi-layered pipes 200 according to the present disclosure, such as may be formed by a machine 50 and or a method according to the present disclosure, are illustrated in FIGS. 3-4.

As schematically illustrated in FIG. 2, machines 50 according to the present disclosure include at least an inner-tube forming device 52, a second-tube forming device 54, and a control system 56. Machines 50 may additionally or alternatively be referred to as pipe-forming assemblies 50 and/or pipe-forming systems.

As schematically illustrated in FIG. 2, inner-tube forming device 52 is positioned to receive a first metal stock 58 from a supply 59, such as a first metal supply 60, and is configured to form an inner metal tube 62 from the first metal stock. This is schematically illustrated in FIG. 2 by the first metal stock being fed, or traveling, from the first metal supply to the inner-tube forming device, as indicated by the illustrated arrow, and the inner metal tube being fed from, or exiting, the inner-tube forming device. Similarly, second-tube forming device 54 is positioned to receive a second metal stock 64 from a supply 59, such as a second metal supply 66, and is configured to form a second metal tube 68 around the inner metal tube from the second metal stock. This is schematically illustrated in FIG. 2 by the second metal stock being fed, or traveling, from the second metal supply to the second-tube forming device, as indicated by the illustrated arrow, and the second metal tube being fed from, or exiting, the second-tube forming device.

Second-tube forming device 54 may form second metal tube 68 around inner metal tube 62 in a tight relationship, such as illustrated in the illustrative, non-exclusive example of a multi-layered pipe 200 of FIG. 3. Stated differently, the inner metal tube and the second metal tube may be tightly nested with respect to each other, such as to have mechanical unity, regardless of an internal pressure within the multi-layered pipe. This configuration may additionally or alternatively be described as one in which the outer surface of the inner metal tube abuts and extends against, and/or tightly rests or extends against, the inner surface of the second metal tube. Additionally or alternatively, second-tube forming device 54 may form the second metal tube around the inner metal tube in a non-, or less than, tight relationship, such as illustrated in the illustrative, non-exclusive example of a multi-layered pipe 200 of FIG. 4. Stated differently, the inner metal tube may have an outer diameter that is less than an inner diameter of the second metal tube, such as to form gaps or spaces between the tubes, at least when the multi-layered pipe has an internal pressure less than a predetermined pressure. For example, while a multi-layered pipe may be formed with a gap between the inner metal tube and the second metal tube, the multi-layered pipe may be configured such that when it is pressurized to a predetermined pressure, such as a typical pressure of hydrocarbons or other fluids being transported within the multi-layered pipe, it is configured to have mechanical unity.

Inner-tube forming device 52 and second-tube forming device 54, and other tube forming devices according to the present disclosure, any and/or all of which may be referred to herein as a, or as an Nth, tube-forming device, may take any suitable form or configuration for forming, constructing, bending, and/or extruding a tube from a metal stock, with such tube being suitable as a layer of a multi-layered pipe 200 according to the present disclosure. For example, a tube-forming device according to the present disclosure may include at least one die, such as may be configured to receive sheet metal and bend the sheet metal into a tube. In some embodiments, the sheet metal is as wide as the circumference of the tube it is to be formed into. In other embodiments, the sheet metal is essentially as wide as the circumference of the tube it is formed into, minus any gap or plus any overlap appropriate for seam welds.

Although any suitable size, type, and/or configuration of die may be utilized, illustrative, non-exclusive examples of suitable dies include fixed and rolling dies. An illustrative, non-exclusive example of a suitable die is disclosed in U.S. Pat. No. 611,222, the disclosure of which is hereby incorporated by reference. Other illustrative, non-exclusive examples of methods for bending sheet metal into tubes, including suitable dies for use in such bending processes, are disclosed in U.S. Pat. Nos. 1,665,851, 1,915,257, 1,954,160, 2,803,730, 3,069,763, and 3,085,146, and in German Patent No. DE3044003, the complete disclosures of which are hereby incorporated by reference.

The inner-tube forming device may include one or more inner-tube dies 74, the second-tube forming device may include one or more second-tube dies 76, and an optional Nth tube-forming device may include one or more Nth-tube dies. Furthermore, methods according to the present disclosure may be described as including the feeding of sheet metal or other metal stock through an inner-tube die, a second-tube die, and/or an Nth-tube die. As used herein, references to an Nth tube-forming device, Nth-tube die, Nth-tube, etc. refer to at least an optional third, fourth, or subsequent such device, die tube, etc., with N being an integer greater than 2. It is within the scope of the present disclosure that the inner metal tube, inner-tube forming device, etc. alternatively or additionally may be referred to as a first metal tube, a first-tube forming device, etc. Likewise, for any multi-layered pipe 200 according to the present disclosure, the pipe will have an outer tube, which may additionally or alternatively be referred to as the outermost tube and/or the exterior tube, and this outer tube may be the second tube, the third tube, the fourth tube, etc., depending on the number of tubes, or layers of tubes, that are formed by machines and/or methods according to the present disclosure when forming a particular multi-layer pipe 200. When a multi-layer pipe 200 according to the present disclosure includes three or more metal tubes, the multi-layer pipe may additionally or alternatively be described as including at least one internal, or intermediate, metal tube, that is positioned between the first, or inner, metal tube, and the Nth, or outer, metal tube.

Other configurations of tube-forming devices are also within the scope of the present disclosure and may be incorporated into machines 50 according to the present disclosure and/or be used with methods according to the present disclosure. For example, as another illustrative, non-exclusive example, tube-forming devices according to the present disclosure may include specially configured rollers for bending sheet metal or other metal stock into a tube, an example of which is disclosed in U.S. Pat. No. 1,665,851, the disclosure of which is hereby incorporated by reference. Although typically configured to form cylindrical tubes, it is within the scope of the present disclosure that tube-forming devices according to the present disclosure may be configured to form any suitable cross-sectional shape of tubes, and tube-forming devices according to the present disclosure are not limited to forming tubes having circular cross-sections. Illustrative, non-exclusive examples of other suitable cross-sectional shapes include generally rectangular, polygonal, elliptical, ovular, and other shapes.

Examples of tube-forming devices that bend sheet metal or other metal stock into respective tubes of a multi-layered pipe 200 according to the present disclosure, whether including die(s), roller(s), and/or other structure, may be described as being configured to bend the sheet metal or other metal stock to form at least one seam. For example, inner-tube forming device 52 may be configured to bend sheet metal to define at least one inner-tube seam 70, as illustrated in the illustrative, non-exclusive examples of multi-layered pipes 200 of FIGS. 3-4. Similarly, second-tube forming device 54 may be configured to bend sheet metal to define at least one second-tube seam 72, and an Nth-tube forming device may be configured to bend sheet metal to define at least one Nth-tube seam. Accordingly, methods according to the present disclosure may be described as including bending sheet metal or other metal stock to define at least one seam. Although not required to all methods, machines, and/or pipes according to the present disclosure, the seams, or seals, will often be longitudinal seams, or longitudinal seals, that extend along the length (i.e., generally parallel to the longitudinal axis), of the corresponding length of pipe.

Additionally or alternatively, a tube-forming device may be configured to bend more than one sheet, or stock metal, and therefore to define more than one seam. This is schematically illustrated in FIGS. 3-4, in which an optional inner-tube seam 70 and an optional second-tube seam 72 are illustrated in dashed lines, representing the formation of the respective tubes by two stocks of sheet metals. In the illustrated examples, the two stocks of sheet metals used to form each section, or region, of the corresponding tube are equally sized, with each tube section defining, or forming, approximately 180° of the circumference of the tube. These sections of the corresponding tube may additionally or alternatively be referred to herein as circumferential pipe sections, such as which are joined together by longitudinal welds, seams, or other seals to collectively form, or define, a tube of a multi-layered pipe according to the present disclosure.

The present disclosure is not limited to tube-forming devices forming tubes from one or two stocks of sheet metal or other metal stock and any suitable number of metal stocks may be used, including one, two, three, and greater than three stocks of the same or different sheet metal or other metal stocks. When the three equal-sized sections are utilized, each section may define, or form, approximately 120° of the circumference of the corresponding tube, when four equal-sized sections are utilized, each section may define, or form, approximately 90° of the circumference of the corresponding tube, etc. When a tube of a multi-layered pipe is formed from two or more sections that are bent from metal stock, or sheet metal stock, such as described herein, it is within the scope of the present disclosure that the sections may have different relative sizes, and thus that each section may define, or form, a different percentage, or portion of the circumference of a corresponding tube.

Additionally or alternatively, as graphically depicted in the illustrative, non-exclusive examples of multi-layered pipes 200 illustrated in FIGS. 3-4, tube-forming devices according to the present disclosure may be positioned and configured so that seams of respective tubes are rotationally or radially offset from each other. While not required to all multi-layered pipes and/or methods according to the present disclosure, a multi-layered pipe with radially, or rotationally, offset seams for the corresponding tubes that comprise the pipe may result in a multi-layered pipe that has greater strength and/or tube-to-tube conformance due to the welds or other seals between the adjacent tubes not being stacked, or aligned, directly against each other. For example, second-tube forming device 54 may be configured to form at least one second-tube seam 72 that is rotationally (or radially or circumferentially) offset from at least one inner-tube seam 70, and an Nth-tube forming device may be configured to form at least one Nth-tube seam that is rotationally or radially offset from at least one (N−1)th-tube seam. Accordingly, a method according to the present disclosure may be described as including the forming of at least one inner-tube seam and the forming of at least one second-tube seam that is rotationally or radially offset from the at least one inner-tube seam. Additionally or alternatively, a method according to the present disclosure may be described as including the forming of at least an Nth-tube seam that is rotationally or radially offset from an (N−1)th-tube seam.

Control system 56 is provided and configured at least to simultaneously feed first metal stock 58 to inner-tube forming device 52 and feed second metal stock 64 to second-tube forming device 54. Accordingly, a method according to the present disclosure for forming a multi-layered pipe 200 according to the present disclosure may be described as forming an inner metal tube from a first metal stock fed from a supply, such as a first metal supply, and while forming the inner metal tube, forming a second metal tube around the inner metal tube from a second metal stock fed from a supply, such as a second metal supply. That is, as first metal stock is being fed to the inner-tube forming device, the second metal stock is being fed to the second-tube forming device, and although spaced apart in relative distance, as schematically illustrated in FIG. 2, the inner metal tube and the second metal tube are being formed simultaneously, at least when machine 50 is operating after a start-up period, for example, in which one of the first metal stock or the second metal stock has yet to reach the inner-tube forming device or the second-tube forming device, respectively. The control system may be configured to feed any number of metal stocks to any number of tube-forming devices in a simultaneous manner, and therefore the control system may be described as being configured to feed an Nth metal stock to an Nth-tube forming device, and methods according to the present disclosure may be described as including, while forming the inner metal tube, forming an Nth metal tube around an (N−1)th metal tube from an Nth metal stock fed from an Nth metal supply.

Stated differently, and in terms of relative longitudinal sections of a multi-layered pipe 200, a method according to the present disclosure may be described as forming the inner metal tube of a first longitudinal section, and then after forming the inner metal tube of the first longitudinal section, forming the second metal tube of the first longitudinal section around the inner metal tube of the first longitudinal section. Similarly, such a method may further include after forming the inner metal tube of the first longitudinal section, forming the inner metal tube of a second longitudinal section, with the second longitudinal section being upstream, or toward the metal supply, or left in the schematic illustration of FIG. 2, of the first longitudinal section. Then, after forming the outer metal tube of the first longitudinal section around the inner metal tube of the first longitudinal section, the method may include forming the outer metal tube of the second longitudinal section around the inner metal tube of the first longitudinal section.

Therefore, while a given cross-section of a multi-layered pipe 200 according to the present disclosure includes at least an inner metal tube cross-section and a second metal tube cross-section, such cross-sections were not formed, or bent, simultaneously by respective tube-forming devices; however, after a start-up period of a machine 50 according to the present disclosure, a section of the inner metal tube is formed simultaneously with another section of the second metal tube that is longitudinally spaced from the section of the inner metal tube being formed, or bent. Furthermore, a section of an (N−1)th metal tube is formed simultaneously with another section of an Nth metal tube that is longitudinally spaced from the second of the (N−1)th metal tube being formed, or bent.

In FIG. 2, control system 56 is schematically illustrated as being operatively linked to the various components, including optional components, of machines 50 according to the present disclosure. Accordingly, FIG. 2 schematically indicates that the control system may, but is not necessarily required to, be configured to control at least some aspect(s) of the respective component. Control system 56, however, is not necessarily a stand-alone component of machines 50 according to the present disclosure, and rather may take any suitable form and include any suitable combination of components, including other components of machines specifically defined herein, such that the control system is at least configured to simultaneously feed first metal stock 58 to inner-tube forming device 52 and feed second metal stock 64 to second-tube forming device 54. The control system may further be configured, as discussed herein, to perform, or control the operation of other components, in a simultaneous manner while the first metal stock is being fed to the inner-tube forming device, while the second metal stock is being fed to the second-tube forming device, and optionally while an Nth metal stock is being fed to an Nth-tube forming device. Control systems according to the present disclosure therefore may include, or may be described as including, one or more of valves, belts, gears, feeders, conveyors, controllers, welders, sensors, electronics, software, computers, wires, and/or other components suitable for the simultaneous nature of the formation of multi-layered pipes according to the present disclosure. Accordingly, a "control system," as used herein, may be defined to include one or more other components or portions of other components of machines 50. That is, control system 56 of machines 50 may include structure that is separately defined herein, and control system 56 should not be interpreted necessarily as a stand-alone component of machines 50, for example, when recited in a claim herein, although it is within the scope of the present disclosure that it may (but is not required to be) so implemented.

As an illustrative, non-exclusive example, machines 50 according to the present disclosure may include a feeding device 77 that is positioned and configured to feed metal stock from the metal supply, or respective metal supplies, to the tube-forming devices. The feeding device 77, when present, may be described as a component of control system 56, in so far as the feeding device implements simultaneous feeding of the first metal stock to the inner-tube forming device and feeding of the second metal stock to the second-tube forming device. Additionally or alternatively, the control system may control the feeding device such that the first metal stock is fed to the inner-tube forming device while the second metal stock is fed to the second-tube forming device and while an Nth metal stock is fed to an Nth-tube forming device.

A metal supply 59, such as first metal supply 60, second metal supply 66, and/or other metal supplies according to the present disclosure, any and all of which may be referred to herein as a, or as an Nth, metal supply, may take any suitable form or configuration. For example, a metal supply may include at least one supply of sheet metal. Such sheet metal may be provided in stacks or other configurations of individual sheets of sheet metal. Additionally or alternatively, sheet metal may be provided in rolls, or spools, of sheet metal. A respective supply of sheet metal, such as first metal supply 60 and second metal supply 66, each includes at least one supply of metal stock, but additionally or alternatively may include more than one supply of metal stock. For example, the first metal supply may include one or more rolls of first sheet metal, the second metal supply may include one or more rolls of second sheet metal, and an Nth metal supply may include one or more rolls of Nth sheet metal. Other configurations of metal supplies are also within the scope of the present disclosure. It is further within the scope of the present disclosure that two or more of the metal stocks may be drawn from the same metal supply.

First metal stock 58, second metal stock 64, and other metal stocks according to the present disclosure, any and all of which may be referred to herein as a, or as an Nth, metal stock, may have any suitable composition and are not required to have the same composition. That is, although not required, the first metal stock may have the same or a different composition than the second metal stock, and an Nth metal stock may have the same or a different composition than an (N−1)th metal stock. Illustrative, non-exclusive examples of suitable metal stocks include (but are not limited to) various compositions of steel, stainless steel, and other metals and metal alloys that are conventionally used and/or are suitable for use in pipelines for extracting and/or transporting hydrocarbons. Compositions of metal stock may be selected for a variety of reasons, including (but not limited to) such illustrative, non-exclusive examples of properties as strength, hardness, ability to be welded, corrosion resistance, etc.

Still referring to FIG. 2, machines 50 according to the present disclosure may further include, but are not required to include in all embodiments, an inner-tube joining device 78 and a second-tube joining device 80. The inner-tube joining device and the second-tube joining device, and other joining devices according to the present disclosure, any and/or all of which may be referred to herein as a, or as an Nth, tube joining device, may take any suitable form or configuration for sealing a respective seam formed by a respective tube-forming device. That is, when present, the inner-tube joining device is positioned and configured to join the at least one inner-tube seam 70 to form at least one inner-tube seal 82, the second-tube joining device is positioned and configured to join the at least one second-tube seam 72 to form at least one second-tube seal 84, and an optional Nth-tube joining device may be positioned and configured to join at least one Nth-tube seam to form at least one Nth-tube seal. Accordingly, a method according to the present disclosure may be described as including joining the at least one inner-tube seam to form at least one inner-tube seal, joining the at least one second-tube seam to form at least one second-tube seal, and so forth. As illustrated in FIG. 2, a joining device, when present, is positioned downstream (i.e., based on the direction of movement of the metal stock and the tube being formed, etc.) of a respective tube-forming device, but upstream of an (N+1)th tube forming device. Such a position enables the sealing of a seam prior to an (N+1)th tube being formed around an Nth tube.

An illustrative, non-exclusive example of a seal is a weld, and any suitable welding and/or other sealing process may be utilized. Some such welding processes may include utilizing flames, electrical arcs, electrical resistive heating, electrical induction heating, friction, electron beams, and/or lasers to form the weld. Moreover, the welding process may or may not utilize additional material (e.g., consumable welding rods) to form the weld. In some embodiments, tube joining devices according to the present disclosure may be described as being configured to weld at least one seam to form at least one seal, or weld, for a respective metal tube. Furthermore, as illustrated in FIGS. 3-4, illustrative, non-exclusive examples of multi-layered pipes 200 according to the present disclosure may include at least one inner-tube seal 82 and second-tube seal 84, and optional second inner-tube and second-tube seals are illustrated in dashed lines.

When machines 50 according to the present disclosure include one or more tube-joining devices, control system 56 may be configured so that the inner-tube joining device forms at least one inner-tube seal 82 while the first metal stock is being fed to the inner-tube forming device, so that the second-tube joining device forms the at least one second-tube seal while the second metal stock is being fed to the second-tube forming device, and so forth. That is, as discussed herein, the control system may be configured so that various operations of machines 50 are performed simultaneously while the various metal stocks are being fed, while the various tubes are being formed, etc., all for an efficient and convenient formation of a multi-layered pipe 200 according to the present disclosure.

Machines 50 according to the present disclosure may also (but are not required to) further include and/or be used with an inner-tube-seal inspecting device 86 and a second-tube-seal inspecting device 88. The inner-tube-seal inspecting device and the second-tube-seal inspecting device, and other inspecting devices according to the present disclosure, any and/or all of which may be referred to herein as a, or as an Nth, tube-seal inspecting device, may take any suitable form or configuration for inspecting a respective seal formed by a respective tube-joining device. That is, when present, the inner-tube-seal inspecting device is positioned and configured to inspect the at least one inner-tube seal 82 for quality, the second-tube-seal inspecting device is positioned and configured to inspect the at least one second-tube seal 84, and an optional Nth-tube-seal inspecting device is positioned and configured to inspect at least one Nth-tube seal. Accordingly, a method according to the present disclosure may be described as including, while forming the inner metal tube, inspecting the inner-tube seal, inspecting the second-tube seal, and so forth. As illustrated in FIG. 2, an inspecting device, when present, is positioned downstream of a respective joining device, but typically upstream of an (N+1)th tube-forming device. Such a position enables the inspection of a seal prior to an (N+1)th tube being formed around an Nth tube and thus around and obstructing an Nth seal.

Illustrative, non-exclusive examples of tube-seal inspecting devices according to the present disclosure include (but are not limited to) radiographic inspection devices, magnetic particle inspection devices, liquid penetrant inspection devices, and ultrasonic inspection devices. Additionally or alternatively, seals may be inspected visually by a person (i.e., manually or visually), and a separate device is not necessarily required to all embodiments of machines 50 according to the present disclosure.

When machines 50 according to the present disclosure include one or more inspecting devices, control system 56 may be configured so that the inner-tube-sealing inspecting device inspects the at least one inner-tube seal for quality while the first metal stock is being fed to the inner-tube forming device so that the second-tube-seal inspecting device inspects the at least one second-tube seal for quality while the second metal stock is being fed to the second-tube forming device, and so forth.

Machines 50 according to the present disclosure may also (but are not required to) further include and/or be used with one or more coating devices 90, such as may be configured to coat, spray, apply, or otherwise deposit a material on one or more of the metal stocks being fed to the tube forming devices. For example, in the example of metal stock being in the form of sheet metal, a material may be deposited by a coating device onto one or both sides of the sheet metal. As schematically indicated in FIG. 2, a coating device 90 may be configured to apply a coating to first metal stock 58 and/or second metal stock 64 as the metal stocks are being fed to the inner-tube forming device and the second-tube forming device, respectively. The schematic illustration of coating device 90 in FIG. 2 indicates that one or more coating devices may be provided. That is, a single coating device may be used that is configured to deposit material on more than one metal stock. Additionally or alternatively, as schematically illustrated by the individual dashed boxes in FIG. 2, individual coating devices may be provided, with each coating device being positioned and configured to apply a coating to a respective metal stock as it is being fed to a respective tube forming device. As used herein "to coat," "a coating," and the like are not interpreted to require that a coating device according to the present disclosure is configured to necessarily completely cover an entire side, surface, or portion of a metal stock or tube with the material being deposited, but rather is interpreted to include any deposition of material, whether completely covering an expanse of material, covering a plurality of spaced-apart portions of material, depositing a predetermined quantity of material, or otherwise.

Additionally or alternatively, machines 50 according to the present disclosure may include one or more coating devices that are positioned and configured to coat, spray, apply, or otherwise deposit a material on one or more of the inside and the outside of a metal tube having been formed by a tube-forming device. Accordingly, as schematically illustrated in FIG. 2, a machine 50 may include an inner-tube coating device 92 positioned and configured to apply a coating to at least one of an inside and an outside of inner metal tube 62. Additionally or alternatively, a machine 50 may include a second-tube coating device 94 positioned and configured to apply a coating to at least one of an inside and an outside of second metal tube 68, and an optional Nth-tube coating device positioned and configured to apply a coating to at least one of an inside and an outside of an Nth metal tube.

Illustrative, non-exclusive examples of materials that may be coated, sprayed, applied, or otherwise deposited on a metal stock prior to the metal stock being formed into a tube or onto the inside or the outside of a metal tube after having been formed by a tube-forming device include (but are not limited to) one or more of a paint, an adhesive, a glue, a cement, an epoxy, a lubricant, a polymeric, a thermal insulating material, an electrical insulating material, a material adapted to distribute stress, and a material adapted to protect against corrosion. Other materials are also within the scope of the present disclosure and the present disclosure is not limited to the illustrative examples of materials enumerated herein.

Machines 50 according to the present disclosure may additionally or alternatively include and/or be used with one or more intermediate-layer positioning devices 96 that are positioned and configured to position an intermediate material between adjacent metal tubes, such as between inner metal tube 62 and second metal tube 68. FIG. 2 schematically indicates an intermediate-layer positioning device in conjunction with inner-tube coating device 92, schematically representing that tube coating devices according to the present disclosure may additionally or alternatively be defined as intermediate-layer positioning devices. However, it is within the scope of the present disclosure that a machine 50 may include none of, one of, or both of a tube coating device and an intermediate-layer positioning device. Intermediate-layer positioning devices may take any suitable form and may position any suitable layer of material between respective metal tubes, and are not limited to the coating, spraying, applying, or depositing material on a surface of a metal tube, but rather may position any suitable material, such as a material already formed into a tube. For example, an intermediate-layer positioning device may be positioned so that an Nth metal tube is fed into an intermediate tube of flexible material, and an (N+1)th tube is formed around the intermediate tube and the Nth metal tube. Other configurations are also within the scope of the present disclosure. Illustrative, non-exclusive examples of suitable materials from which an intermediate layer may be constructed include (but are not limited to) one or more of a paint, an adhesive, a glue, a cement, an epoxy, a lubricant, a polymeric, a thermal insulating material, an electrical insulating material, a material adapted to distribute stress, and a material adapted to protect against corrosion. In particular, an intermediate layer, when present, may be non-metallic. Material positioned by an intermediate-layer positioning device may be described as an intermediate layer or as an intermediate tube.

The schematic illustration of the illustrative, non-exclusive examples of multi-layered pipes 200 of FIGS. 3-4 are interpreted to include optional material(s) 97 deposited or otherwise positioned on one or more of the inside of the inner metal tube, the outside of the inner metal tube, the inside of the second metal tube, and the outside of the second metal tube, by one or more tube-coating devices and/or one or more intermediate-layer positioning devices, as discussed herein.

The various components of machines 50 according to the present disclosure may (but are not required to) be coupled to a common object 98, an illustrative, non-exclusive example of which includes a vehicle 102. For example, the vehicle may be a land-based vehicle, such as a truck, rail-car, or other vehicle configured to facilitate transport of the machine from one land location to another, and more specifically from one multi-layered pipe installation site to another. Additionally or alternatively, the vehicle may be a marine-based vehicle, such as a ship, barge, or other boat configured to facilitate transport of the machine from one marine location to another, and more specifically from one multi-layered pipe installation site to another. Vehicles 102 according to the present disclosure may be considered a component of a machine 50 according to the present disclosure. Additionally or alternatively, a machine 50 may be coupled, and in some embodiments removably coupled, to a vehicle. As schematically indicated by an arrow in FIG. 2 at 104, the multi-layered pipe is fed from, or translated relative to, object 98.

In some embodiments, although not required, control system 56 may be configured so that vehicle 102, when present, translates relative to a ground surface and so that the multi-layered pipe 200 being formed by machine 50 is fed from the vehicle as it is being formed. Accordingly, as the vehicle travels relative to a ground surface, such as at an installation site, or at least adjacent to an installation site, the multi-layered pipe will be deposited in a desired location while the multi-layered pipe is being formed. Additionally or alternatively, the control system may be configured so that a rate at which the vehicle translates relative to the ground surface is equal to a rate at which the multi-layered pipe is fed from the vehicle so that the multi-layered pipe is positioned on the ground surface and at least initially does not translate relative to the ground surface. Such a configuration is not limited to land-based vehicles and also may be implemented in conjunction with marine-based vehicles, in which a multi-layered pipe is being positioned at an offshore installation site.

As mentioned, machines 50 according to the present disclosure include at least inner-tube forming device 52 and second-tube forming device 54, but may further include additional forming devices and related optional components. Accordingly, FIG. 2 schematically includes an optional third-tube forming device 106 positioned to receive a third metal stock 108 from a supply 59, such as a third metal supply 110, and which is configured to form a third metal tube 112 around second metal tube 68 from the third metal stock. Such machines may also include one or more of an optional third-tube joining device 114, an optional third-tube inspecting device 116, and an optional third-tube coating device 118. Any number of such components may be incorporated into a machine 50 according to the present disclosure, and thus a machine may be configured to form a multi-layered pipe with any number of metal tubes, or N tubes, and the present disclosure is not limited to multi-layered pipes 200 having only two or three metal tubes.

Multi-layered pipes 200 according to the present disclosure may be formed in a variety of suitable sizes and lengths and having a variety of suitable properties, including formed with a variety of suitable sizes and properties of metal tubes. As illustrative, non-exclusive examples, a multi-layered pipe 200 according to the present disclosure may (but is not required to) have an outer diameter greater than 150, 200, 300, 450, or 600 mm, and/or an outer diameter between (about) 150 mm and (about) 1000 mm. Forming long pipeline segments (such as pipeline segments that are at least 200 meters in length in the field may lead to reduced pipeline cost and faster pipeline laying rates by reducing the number of end-to-end welding requirements. As further illustrative, non-exclusive examples, a multi-layered pipe according to the present disclosure may have a thickness greater than 10, 15, 25, or 30 mm, and/or a thickness between (about) 10 mm and (about) 40 mm. Additionally or alternatively, one or more of an inner metal tube, a second metal tube, a third metal tube (when present), and an Nth metal tube (when present) may have a thickness less than 5, 10, or 25 mm, a thickness of between (about) 3 mm and (about) 20 mm, and/or a thickness of between (about) 3 mm and (about) 7 mm. Due to the pipe being formed from metal stock, such as sheet metal stock, multi-layered pipes according to the present disclosure may be readily joined (i.e., constructed of suitable metallic materials) with conventional metal pipes using conventional fittings and welding processes.

Additionally or alternatively, a machine according to the present disclosure may be configured to form a multi-layered pipe having a length of at least 10, 30, 50, 10, 200, or 300 m, and/or a length of at least 100 times an outer diameter of the multi-layered pipe. Additionally or alternatively, a machine according to the present disclosure may be configured to form a multi-layered pipe that is configured to withstand an internal pressure of at least 3.45 MPa, 6.89 MPa, 20.7 MPa, 34.5 MPa, or even 68.9 MPa.

Other sizes, lengths, and pressure ratings are also within the scope of the resent disclosure, and the present disclosure is not limited to the enumerated values and ranges herein. Also, as the multi-layered pipes are formed from metal stocks, the metal stocks may be selected not only to permit welding of the bent stocks to form the individual tubes of the pipe using conventional welding techniques, but also to join separate lengths of pipe 200 together and/or to one or more lengths of conventional (single layer) metal pipes.

As discussed, installation sites for multi-layered pipes 200 according to the present disclosure may be in a variety of locations. Accordingly, machines 50 according to the present disclosure may be positioned in the same variety of locations or at least proximate to such installation sites. That is, a machine 50 may be positioned at least proximate to an installation site for a multi-layered pipe formed by the machine. Additionally or alternatively, a machine may be positioned within 0.1, 0.5, 1, 5, 10, 25, 50, or 100 km of an installation site for a multi-layered pipe according to the present disclosure. Additionally or alternatively, a machine may be positioned proximate to a drilling site for hydrocarbons and/or proximate to a wellbore associated with a hydrocarbon extraction site. Additionally or alternatively, a machine according to the present disclosure may be configured to position a multi-layered pipe formed by the machine into a wellbore associated with a hydrocarbon extraction site. Other locations are also within the scope of the present disclosure, including locations having distances relative to an installation site other than the enumerated values herein.

Figure 5:
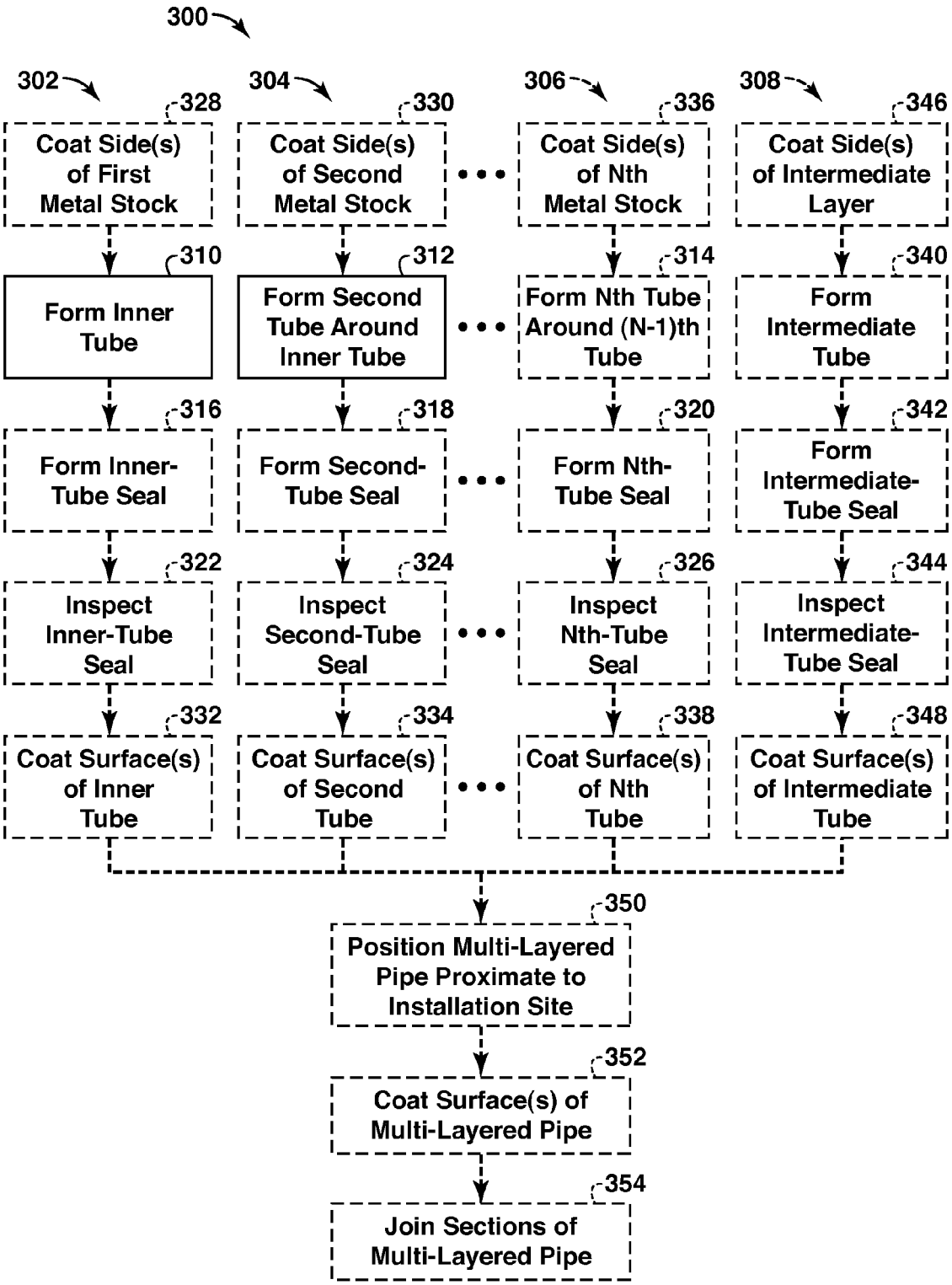
FIG. 5 is a flow chart schematically illustrating illustrative, non-exclusive examples of methods according to the present disclosure for forming multi-layered pipes according to the present disclosure.

Turning now to FIG. 5, illustrative, non-exclusive examples of methods of forming multi-layered pipes 200 are schematically illustrated and are indicated generally at 300. Methods according to the present disclosure and machines according to the present disclosure may be mutually exclusive, and methods according to the present disclosure are not required to (but may) be performed by machines 50 according to the present disclosure.

The schematic diagram of FIG. 5 is not interpreted as a typical flow chart representing a time-based flow of steps of the methods. Rather, any and all of the illustrated steps, including the illustrated optional steps of methods 300 may be performed simultaneously. Furthermore, the upper portion of the schematic diagram of FIG. 5 is organized in columns, with the first column (indicated at 302) representing the flow of material associated with the formation of a section of an inner tube, with the second column (indicated at 304) representing the flow of material associated with the formation of a section of a second tube, with the third column (indicated at 306) representing the flow of material associated with the formation of a section of an optional Nth tube if more than two tubes are present in the multi-layered pipe being formed, and with the fourth column (indicated at 308) representing the flow of material associated with the formation and/or insertion of a section of an optional intermediate layer, when present. The lower portion of the schematic diagram of FIG. 5 includes a single column including optional steps performed after a multi-layered pipe is actually formed. Finally, it is noted that FIG. 5 illustrates optional steps of methods 300 according to the present disclosure in dashed boxes.

Accordingly, methods 300 according to the present disclosure include at least forming an inner metal tube from a first metal stock fed from a first metal supply, as indicated at 310, and while forming the inner metal tube, forming a second metal tube around the inner metal tube from a second metal stock fed from a second metal supply, as indicated at 312. In methods 300 in which more than two metal tubes are formed, methods may further include, while forming the inner metal tube, forming an Nth tube around an (N−1)th metal tube from an Nth metal stock fed from an Nth metal supply, as indicated at 314.

As discussed herein, the formation of a metal tube may include the bending of sheet metal to form at least one seam, and the at least one seam may be subsequently sealed, such as by welding. Accordingly, methods 300 may further include joining at least one inner-tube seam to form an at least one inner-tube seal, as indicated at 316, and joining at least one second-tube seam to form an at least one second-tube seal, as indicated at 318. In methods in which more than two metal tubes are formed, methods may further include joining at least one Nth-tube seam to form an at least one Nth-tube seal, as indicated at 320.

Next, although not required, methods 300 may further include inspecting the at least one inner-tube seal, as indicated at 322, and inspecting the at least one second-tube seal, as indicated at 324. In methods in which more than two metal tubes are formed, methods may further include inspecting the at least one Nth-tube seal, as indicated at 326.

As discussed herein, the metal stock from which a metal tube is formed may have a material coated, sprayed, or otherwise deposited on it, for example by a coating device. Additionally or alternatively, a metal tube, after having been formed by a tube-forming device, may be coated with a material on one or both of an inside and an outside of the metal tube. Accordingly, FIG. 5 schematically includes the optional steps of coating one or more sides of the first metal stock used to form the inner metal tube, as indicated at 328, coating one or more side of the second sheet stock used to form the second metal tube, as indicated at 330, coating one or more of the inside and the outside of the inner metal tube, as indicated at 332, and coating one or more of the inside and the outside of the second metal tube, as indicated at 334. As discussed the first and second (and Nth) metal stocks may be formed from one or more materials and may have the same or different compositions. Moreover, the metal stocks may be delivered in sheets, rolls (coils of rolled sheets), or other suitable forms prior to being formed into tubes according to the present disclosure. In methods in which more than two metal tubes are formed, methods may further include coating one or more sides of the Nth sheet metal used to form the Nth metal tube, as indicated at 336, and coating one or more of the inside and the outside of the Nth metal tube, as indicated at 338.

As discussed herein, an intermediate layer of material may be positioned between adjacent metal tubes, such as between the inner metal tube and the second metal tube, or between an Nth metal tube and an (N−1)th metal tube. Accordingly, some methods according to the present disclosure may optionally include one or more of forming an intermediate tube, or layer, as indicated at 340, forming an intermediate-tube seal, as indicated at 342, inspecting the intermediate-tube seal, as indicated at 344, coating one or more sides of material from which the intermediate tube is formed, as indicated at 346, and coating one or more of the inside and the outside of the intermediate tube, as indicated 348.

Referring now to the lower portion of the schematic diagram of FIG. 5, a multi-layered pipe formed with an inner metal tube and a second metal tube, and optionally one or more of an Nth metal tube and an intermediate tube, may be positioned proximate to an installation site, as discussed herein. That is, a method 300 according to the present disclosure may include positioning the multi-layered pipe 200 proximate to the installation site, as indicated at 350, while the multi-layered pipe is being formed. Additionally, and not necessarily after the positioning of the multi-layered pipe, a method may include coating one or more of the inside or the outside of the multi-layered pipe, as indicated at 352. Finally, and not necessarily after the optional coating of the multi-layered pipe, a method may include joining two sections of multi-layered pipes together, as indicated at 354. Specifically, it is within the scope of the present disclosure that steps 350-354, if performed in a particular method 300 according to the present disclosure may be performed in a different order than the illustrative, non-exclusive example shown in FIG. 5.

Methods according to the present disclosure may additionally or alternatively include steps other than those schematically illustrated in the diagram of FIG. 5, including such steps as described herein, such steps as may be implemented by a machine 50 according to the present disclosure, and such additional steps as may be suitable for a particular application. For example, as an illustrative, non-exclusive example, a method according to the present disclosure may (but is not required to) additionally include ceasing the forming of the inner metal tube, ceasing the forming of the second metal tube, ceasing the forming of the third metal tube (when present), and ceasing the forming of the Nth metal tube (when present) when a length of the multi-layered pipe is greater than or equal to a predetermined length. Illustrative, non-exclusive examples of predetermined lengths include lengths of at least 10, 30, 50, 100, 200, and 300 m, and lengths of at least 100 times an outer diameter of the multi-layered pipe.

Methods according to the present disclosure and machines according to the present disclosure may be mutually exclusive. That is, a method according to the present disclosure is not required to (but may) be performed by a machine according to the present disclosure, and a machine according to the present disclosure is not required to (but may) perform a method according to the present disclosure.

Illustrative, non-exclusive examples of methods, multi-layered pipes, and machines according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A A method of forming a multi-layered pipe, the method comprising:

forming an inner metal tube from a first metal stock fed from a supply; and while forming the inner metal tube, forming a second metal tube around the inner metal tube from a second metal stock fed from a supply.

A1 The method of paragraph A, wherein the supply includes at least one supply of first sheet metal.

A2 The method of paragraph A1, wherein the at least one supply of first sheet metal includes at least one roll of first sheet metal.

A3 The method of any of paragraphs A1-A2, wherein the forming the inner metal tube includes bending the first sheet metal to define at least one inner-tube seam, and optionally wherein the inner-tube seam is a longitudinal seam that extends generally parallel to a longitudinal axis of the inner metal tube.

A4 The method of paragraph A3, wherein the bending the first sheet metal includes feeding the first sheet metal through an inner-tube die.

A5 The method of any of paragraphs A3-A4, wherein the forming the inner metal tube further includes joining the at least one inner-tube seam to form at least one inner-tube seal, and optionally wherein the inner-tube seal is a longitudinal seal that extends generally parallel to a longitudinal axis of the inner metal tube.

A6 The method of paragraph A5, further comprising:

while forming the inner metal tube, inspecting the at least one inner-tube seal.

A7 The method of any of paragraphs A5-A6, wherein the joining the at least one inner-tube seam includes welding.

A8 The method of any of paragraphs A1-A7, further comprising:

applying a coating to at least one side of the first sheet metal.

A9 The method of paragraph A8, wherein the applying a coating to at least one side of the first sheet metal is performed while forming the inner metal tube.

A10 The method of paragraph A8, wherein the applying a coating to at least one side of the first sheet metal is performed prior to forming the inner metal tube.

A11 The method of any of paragraphs A8-A10, wherein the coating applied to at least one side of the first sheet metal includes one or more of a paint, an adhesive, a glue, a cement, an epoxy, a lubricant, a polymeric, a thermal insulating material, an electrical insulating material, a material adapted to distribute stress, and a material adapted to protect against corrosion.

A12 The method of any of paragraphs A-A11, wherein the supply includes at least one supply of second sheet metal.

A13 The method of paragraph A12, wherein the at least one supply of second sheet metal includes at least one roll of second sheet metal.

A14 The method of any of paragraph A12-A13, wherein the forming the second metal tube includes bending the second sheet metal to define at least one second-tube seam, and optionally wherein the second-tube seam is a longitudinal seam that extends generally parallel to a longitudinal axis of the second metal tube.

A15 The method of paragraph A14, wherein the bending the second sheet metal includes feeding the second sheet metal through a second-tube die.

A16 The method of any of paragraphs A14-A15, wherein the forming the second metal tube further includes joining the at least one second-tube seam to form at least one second-tube seal, and optionally wherein while forming the at least one inner-tube seal, forming at least one second-tube seal.

A17 The method of paragraph A16, further comprising:

while forming the inner metal tube, inspecting the at least one second-tube seal.

A18 The method of any of paragraphs A16-A17, wherein the joining the at least one second-tube seam includes welding.

A19 The method of any of paragraphs A12-A17, further comprising:

applying a coating to at least one side of the second sheet metal.

A20 The method of paragraph A19, wherein the applying a coating to at least one side of the second sheet metal is performed while forming the inner metal tube.

A21 The method of paragraph A19, wherein the applying a coating to at least one side of the second sheet metal is performed prior to forming the inner metal tube.

A22 The method of any of paragraphs A19-A21, wherein the coating applied to at least one side of the second sheet metal includes one or more of a paint, an adhesive, a glue, a cement, an epoxy, a lubricant, a polymeric, a thermal insulating material, an electrical insulating material, a material adapted to distribute stress, and a material adapted to protect against corrosion.

A23 The method of any of paragraphs A-A22, further comprising:

while forming the inner metal tube, forming an Nth metal tube around an (N−1)th metal tube from an Nth metal stock fed from a supply, and further wherein N is an integer greater than or equal to 3.

A24 The method of paragraph A23, wherein the Nth metal supply includes at least one supply of Nth sheet metal.

A25 The method of paragraph A24, wherein the at least one supply of Nth sheet metal includes at least one roll of Nth sheet metal.

A26 The method of any of paragraphs A24-A25, wherein the forming the Nth metal tube includes bending the Nth sheet metal to define at least one Nth-tube seam.

A27 The method of paragraph A26, wherein the bending the Nth sheet metal includes feeding the Nth sheet metal through an Nth-tube die.

A28 The method of any of paragraphs A26-A27, wherein the forming the Nth metal tube further includes joining the at least one Nth-tube seam to form at least one Nth-tube seal.

A29 The method of paragraph A28, further comprising:

while forming the inner metal tube, inspecting the at least one Nth-tube seal.

A30 The method of any of paragraphs A28-A29, wherein the joining the at least one Nth-tube seam includes welding.

A31 The method of any of paragraphs A24-A30, further comprising:

applying a coating to at least one side of the Nth sheet metal.

A32 The method of paragraph A31, wherein the applying a coating to at least one side of the Nth sheet metal is performed while forming the inner metal tube.

A33 The method of paragraph A31, wherein the applying a coating to at least one side of the Nth sheet metal is performed prior to forming the inner metal tube.

A34 The method of any of paragraphs A31-A33, wherein the coating applied to at least one side of the Nth sheet metal includes one or more of a paint, an adhesive, a glue, a cement, an epoxy, a lubricant, a polymeric, a thermal insulating material, an electrical insulating material, a material adapted to distribute stress, and a material adapted to protect against corrosion.

A35 The method of any of paragraphs A-A34, further comprising:

while forming the inner metal layer, applying a coating to at least one of an inside surface and an outside surface of the inner metal tube.

A36 The method of paragraph A35, wherein the coating applied to at least one of the inside surface and the outside surface of the inner metal tube includes one or more of a paint, an adhesive, a glue, a cement, an epoxy, a lubricant, a polymeric, a thermal insulating material, an electrical insulating material, a material adapted to distribute stress, and a material adapted to protect against corrosion.

A37 The method of any of paragraphs A-A36, further comprising:

while forming the inner metal layer, applying a coating to at least one of an inside surface and an outside surface of the second metal tube.

A38 The method of paragraph A37, wherein the coating applied to at least one of the inside surface and the outside surface of the second metal tube includes one or more of a paint, an adhesive, a glue, a cement, an epoxy, a lubricant, a polymeric, a thermal insulating material, an electrical insulating material, a material adapted to distribute stress, and a material adapted to protect against corrosion.

A39 The method of any of paragraphs A23-A38, further comprising:

while forming the inner metal layer, applying a coating to at least one of an inside surface and an outside surface of a third metal tube.

A40 The method of paragraph A39, wherein the coating applied to at least one of the inside surface and the outside surface of the third metal tube includes one or more of a paint, an adhesive, a glue, a cement, an epoxy, a lubricant, a polymeric, a thermal insulating material, an electrical insulating material, a material adapted to distribute stress, and a material adapted to protect against corrosion.

A41 The method of any of paragraphs A23-A40, further comprising:

while forming the inner metal layer, applying a coating to at least one of an inside surface and an outside surface of the Nth metal tube.

A42 The method of paragraph A41, wherein the coating applied to at least one of the inside surface and the outside surface of the Nth metal tube includes one or more of a paint, an adhesive, a glue, a cement, an epoxy, a lubricant, a polymeric, a thermal insulating material, an electrical insulating material, a material adapted to distribute stress, and a material adapted to protect against corrosion.

A43 The method of any of paragraphs A-A42, further comprising:

while forming the inner metal tube, positioning an intermediate material between the inner metal tube and the second metal tube.

A44 The method of paragraph A43, wherein the intermediate material positioned between the inner metal tube and the second metal tube includes one or more of a paint, an adhesive, a glue, a cement, an epoxy, a lubricant, a polymeric, a thermal insulating material, an electrical insulating material, a material adapted to distribute stress, and a material adapted to protect against corrosion.

A45 The method of any of paragraphs A43-A44, wherein the intermediate layer positioned between the inner metal tube and the second metal tube is non-metallic.

A46 The method of any of paragraphs A23-A45, further comprising:

while forming the inner metal tube, positioning an intermediate material between the second metal tube and the third metal tube.

A47 The method of paragraph A46, wherein the intermediate material positioned between the second metal tube and the third metal tube includes one or more of a paint, an adhesive, a glue, a cement, an epoxy, a lubricant, a polymeric, a thermal insulating material, an electrical insulating material, a material adapted to distribute stress, and a material adapted to protect against corrosion.

A48 The method of any of paragraphs A46-A47, wherein the intermediate layer between the second metal tube and the third metal tube is non-metallic.

A49 The method of any of paragraphs A23-A48, further comprising:

while forming the inner metal tube, positioning an intermediate material between the (N−1)th metal tube and the Nth metal tube.

A50 The method of paragraph A49, wherein the intermediate material between the (N−1)th metal tube and the Nth metal tube includes one or more of a paint, an adhesive, a glue, a cement, an epoxy, a lubricant, a polymeric, a thermal insulating material, an electrical insulating material, a material adapted to distribute stress, and a material adapted to protect against corrosion.

A51 The method of any of paragraphs A49-A50, wherein the intermediate layer between the (N−1)th metal tube and the Nth metal tube is non-metallic.

A52 The method of any of paragraphs A-A51, wherein the multi-layered pipe has an outer diameter between about 150 mm and about 1000 mm.

A53 The method of any of paragraphs A-A51, wherein the multi-layered pipe has an outer diameter greater than 150 mm.

A54 The method of any of paragraphs A-A51, wherein the multi-layered pipe has an outer diameter greater than 200 mm.

A55 The method of any of paragraphs A-A51, wherein the multi-layered pipe has an outer diameter greater than 300 mm.

A56 The method of any of paragraphs A-A51, wherein the multi-layered pipe has an outer diameter greater than 450 mm.

A57 The method of any of paragraphs A-A51, wherein the multi-layered pipe has an outer diameter greater than 600 mm.

A58 The method of any of paragraphs A-A57, wherein the multi-layered pipe has a thickness between about 10 mm and about 40 mm.

A59 The method of any of paragraphs A-A57, wherein the multi-layered pipe has a thickness greater than 10 mm.

A60 The method of any of paragraphs A-A57, wherein the multi-layered pipe has a thickness greater than 15 mm.

A61 The method of any of paragraphs A-A57, wherein the multi-layered pipe has a thickness greater than 25 mm.

A62 The method of any of paragraphs A-A57, wherein the multi-layered pipe has a thickness greater than 35 mm.

A63 The method of any of paragraphs A-A62, wherein one or more of the inner metal tube, the second metal tube, the third metal tube (when present), and the Nth metal tube (when present) has a thickness between about 3 mm and about 20 mm.

A64 The method of any of paragraphs A-A62, wherein one or more of the inner metal tube, the second metal tube, the third metal tube (when present), and the Nth metal tube (when present) has a thickness less than 5 mm.

A65 The method of any of paragraphs A-A62, wherein one or more of the inner metal tube, the second metal tube, the third metal tube (when present), and the Nth metal tube (when present) has a thickness less than 10 mm.

A66 The method of any of paragraphs A-A62, wherein one or more of the inner metal tube, the second metal tube, the third metal tube (when present), and the Nth metal tube (when present) has a thickness less than 25 mm.

A67 The method of any of paragraphs A-A62, wherein one or more of the inner metal tube, the second metal tube, the third metal tube (when present), and the Nth metal tube (when present) has a thickness between about 3 mm and about 7 mm.

A68 The method of any of paragraphs A-A67, further comprising:

ceasing the forming of the inner metal tube, ceasing the forming of the second metal tube, ceasing the forming of the third metal tube (when present), and ceasing the forming of the Nth metal tube (when present) when a length of the multi-layered pipe is greater than or equal to a predetermined length.

A69 The method of paragraph A68, wherein the predetermined length is at least 10 m.

A70 The method of paragraph A68, wherein the predetermined length is at least 30 m.

A71 The method of paragraph A68, wherein the predetermined length is at least 50 m.

A72 The method of paragraph A68, wherein the predetermined length is at least 100 m.

A73 The method of paragraph A68, wherein the predetermined length is at least 200 m.

A74 The method of paragraph A68, wherein the predetermined length is at least 300 m.

A75 The method of paragraph A68, wherein the predetermined length is at least 100 times an outer diameter of the multi-layered pipe.

A76 The method of any of paragraphs A-A75, wherein the multi-layered pipe is configured to withstand an internal pressure of at least 3.45 MPa.

A77 The method of any of paragraphs A-A75, wherein the multi-layered pipe is configured to withstand an internal pressure of at least 6.89 MPa.

A78 The method of any of paragraphs A-A75, wherein the multi-layered pipe is configured to withstand an internal pressure of at least 10.3 MPa, optionally wherein the multi-layered pipe is configured to withstand an internal pressure of at least 20.7 MPa, optionally wherein the multi-layered pipe is configured to withstand an internal pressure of at least 34.5 MPa, and further optionally wherein the multi-layered pipe is configured to withstand an internal pressure of at least 68.9 MPa.

A79 The method of any of paragraphs A-A78, wherein the inner metal tube has an outer diameter less than an inner diameter of the second metal tube at least when the multi-layered pipe has an internal pressure less than a predetermined pressure.

A80 The method of any of paragraphs A-A78, wherein the inner metal tube and the second metal tube are tightly nested with respect to each other, regardless of an internal pressure within the multi-layered pipe.

A81 The method of any of paragraphs A-A80, wherein the multi-layered pipe is configured to have mechanical unity at least when internally pressurized to a predetermined pressure, and optionally wherein the predetermined pressure is at least 3.45 MPa, at least 6.89 MPa, at least 10.3 MPa, at least 20.7 MPa, at least 34.5 MPa, and/or at least 68.9 MPa.

A82 The method of any of paragraphs A-A81, further comprising:

while forming the inner metal tube, feeding the multi-layered pipe at least proximate to an installation site for the multi-layered pipe, and optionally wherein the installation site is a hydrocarbon industry installation site.

A83 The method of paragraph A82, wherein the method is performed within 100 km of the installation site.

A84 The method of paragraph A82, wherein the method is performed within 50 km of the installation site.

A85 The method of paragraph A82, wherein the method is performed within 25 km of the installation site.

A86 The method of paragraph A82, wherein the method is performed within 10 km of the installation site.

A87 The method of paragraph A82, wherein the method is performed within 5 km of the installation site.

A88 The method of paragraph A82, wherein the method is performed within 1 km of the installation site.

A89 The method of paragraph A82, wherein the method is performed within 0.5 km of the installation site.

A90 The method of paragraph A82, wherein the method is performed within 0.1 km of the installation site.

A91 The method of any of paragraphs A-A90, wherein the method is performed proximate to a hydrocarbon extraction site.

A92 The method of any of paragraphs A-A91, wherein the method is performed proximate to a wellbore associated with a hydrocarbon extraction site.

A93 The method of any of paragraphs A-A92, wherein the method is performed proximate to a drilling site for hydrocarbons.

A94 The method of any of paragraphs A-A93, further comprising:

while forming the inner metal tube, positioning the multi-layered pipe into a wellbore associated with a hydrocarbon extraction site.

A95 The method of any of paragraphs A-A93, wherein the forming the inner metal tube, the forming the second metal tube, forming the third metal tube (when present), and the forming the Nth metal tube (when present) are performed on a vehicle.

A96 The method of paragraph A95, further comprising:

translating the vehicle relative to a ground surface and feeding the multi-layered pipe from the vehicle.

A97 The method of paragraph A96, wherein the translating the vehicle occurs at a rate equal to a rate at which the multi-layered pipe is fed from the vehicle so that the multi-layered pipe is positioned on the ground surface and at least initially does not translate relative to the ground surface.

A98 The method of any of paragraphs A95-A97, wherein the vehicle is a land-based vehicle.

A99 The method of any of paragraphs A95-A97, wherein the vehicle is a marine-based vehicle.

A100 The method of any of paragraphs A-A99, wherein the first metal stock has a different composition than the second metal stock.

A101 The method of any of paragraphs A23-A100, wherein a third metal stock has a different composition than one or more of the first metal stock and the second metal stock.

A102 The method of any of paragraphs A23-A101, wherein the Nth metal stock has a different composition than one or more of the first metal stock, the second metal stock, and the third metal stock.

A103 The method of any of paragraphs A-A102, wherein the forming the inner metal tube includes forming at least one inner-tube seam; and wherein the forming the second metal tube includes forming at least one second-tube seam that is radially offset from the at least one inner-tube seam.

A104 The method of paragraph A103, wherein the forming the third metal tube (when present) includes forming at least one third-tube seam that is radially offset from the at least one second-tube seam.

A105 The method of any of paragraphs A23-A104, wherein the forming the Nth metal tube includes forming at least an Nth-tube seam that is radially offset from an (N−1) th-tube seam.

A106 The method of any of paragraphs A-A105, wherein the multi-layered pipe is configured to be used as at least a portion of a hydrocarbon pipeline.

A107 The method of any of paragraphs A-A106, wherein the multi-layered pipe is configured to be used as at least a portion of, and optionally as, an above-the-ground pipeline.

A108 The method of any of paragraphs A-A106, wherein the multi-layered pipe is configured to be used as at least a portion of, and optionally as, a subterranean pipeline.

A109 The method of any of paragraphs A-A106, wherein the multi-layered pipe is configured to be used as at least a portion of, and optionally as, an underwater pipeline.

A110 The method of any of paragraphs A-A106, wherein the supply includes at least a first metal supply of the first metal stock and a second metal supply of the second metal stock.

A111 The method of any of paragraphs A23-A34, wherein the supply includes an Nth metal supply of the Nth metal stock.

A112 The method of any of paragraphs A-A111, wherein at least one of the tubes of the multi-layered pipe is formed by joining at least two longitudinal seams to form a complete tube circumference.

A113 The method of any of paragraphs A-A112, wherein the method is for forming a multi-layered pipe for use in the hydrocarbon industry, such as in the extraction and/or transportation of hydrocarbons.

B A multi-layered pipe constructed according to the method of any of paragraphs A-A113.

B1 The use of the multi-layered pipe according to paragraph B to transport hydrocarbon fluid.

B2 The use of the multi-layered pipe of paragraph B or B1 in the hydrocarbon industry, such as in the extraction and/or transportation of hydrocarbons.

C A machine for forming a multi-layered pipe, the machine comprising:

an inner-tube forming device positioned to receive a first metal stock from a supply and configured to form an inner metal tube from the first metal stock;

a second-tube forming device positioned to receive a second metal stock from a supply and configured to form a second metal tube around the inner metal tube from the second metal stock; and a control system configured to simultaneously feed the first metal stock to the inner-tube forming device and feed the second metal stock to the second-tube forming device.

C1 The machine of paragraph C, wherein the first metal supply includes at least one supply of first sheet metal.

C2 The machine of paragraph C1, wherein the at least one supply of first sheet metal includes at least one roll of first sheet metal.

C3 The machine of any of paragraphs C1-C2, wherein the inner-tube forming device is configured to bend the first sheet metal to define at least one inner-tube seam.

C4 The machine of paragraph C3, wherein the inner-tube forming device includes an inner-tube die.

C5 The machine of any of paragraphs C3-C4, further comprising:

an inner-tube joining device positioned and configured to join the at least one inner-tube seam to form at least one inner-tube seal.

C6 The machine of paragraph C5, wherein the control system is further configured so that the inner-tube joining device forms the at least one inner-tube seal while the first metal stock is being fed to the inner-tube forming device.

C7 The machine of any of paragraphs C5-C6, wherein the inner-tube joining device is configured to weld the at least one inner-tube seam to form the at least one inner-tube seal.

C8 The machine of any of paragraphs C5-C7, further comprising:

an inner-tube-seal inspecting device positioned and configured to inspect the at least one inner-tube seal for quality.

C9 The machine of paragraph C8, wherein the control system is further configured so that the inner-tube-seal inspecting device inspects the at least one inner-tube seal for quality while the first metal stock is being fed to the inner-tube forming device.

C10 The machine of any of paragraphs C1-C9, further comprising:

a first-sheet-metal coating device positioned and configured to apply a coating to at least one side of the first sheet metal.

C11 The machine of paragraph C10, wherein the control system is further configured so that the first-sheet-metal coating device applies the coating to the at least one side of the first sheet metal while the first metal stock is being fed to the inner-tube forming device.

C12 The machine of any of paragraphs C10-C11, wherein the coating applied to at least one side of the first sheet metal includes one or more of a paint, an adhesive, a glue, a cement, an epoxy, a lubricant, a polymeric, a thermal insulating material, an electrical insulating material, a material adapted to distribute stress, and a material adapted to protect against corrosion.

C13 The machine of any of paragraphs C-C12, wherein the second metal supply includes at least one supply of second sheet metal.

C14 The machine of paragraph C13, wherein the at least one supply of second sheet metal includes at least one roll of second sheet metal.

C15 The machine of any of paragraphs C13-C14, wherein the second-tube forming device is configured to bend the second sheet metal to define at least one second-tube seam.

C16 The machine of paragraph C15, wherein the second tube forming device includes a second-tube die.

C17 The machine of any of paragraphs C15-C16, further comprising:

a second-tube joining device positioned and configured to join the at least one second-tube seam to form at least one second-tube seal.

C18 The machine of paragraph C17, wherein the control system is further configured so that the second-tube joining device forms the at least one second-tube seal while the second metal stock is being fed to the second-tube forming device.

C19 The machine of any of paragraphs C17-C18, wherein the second-tube joining device is configured to weld the at least one second-tube seam to form the at least one second-tube seal.

C20 The machine of any of paragraphs C17-C19, further comprising:

a second-tube-seal inspecting device positioned and configured to inspect the at least one second-tube seal for quality.

C21 The machine of paragraph C20, wherein the control system is further configured so that the second-tube-seal inspecting device inspects the at least one second-tube seal for quality while the second metal stock is being fed to the second-tube forming device.

C22 The machine of any of paragraphs C13-C19, further comprising:

a second-sheet-metal coating device positioned and configured to apply a coating to at least one side of the second sheet metal.

C23 The machine of paragraph C22, wherein the control system is further configured so that the second-sheet-metal coating device applies the coating to the at least one side of the second sheet metal while the second metal stock is being fed to the second-tube forming device.

C24 The machine of any of paragraphs C22-C23, wherein the coating applied to at least one side of the second sheet metal includes one or more of a paint, an adhesive, a glue, a cement, an epoxy, a lubricant, a polymeric, a thermal insulating material, an electrical insulating material, a material adapted to distribute stress, and a material adapted to protect against corrosion.

C25 The machine of any of paragraphs C-C24, further comprising:

an Nth-tube forming device positioned to receive an Nth metal stock from a supply and configured to form an Nth metal tube around an (N−1)th metal tube from the Nth metal stock;

wherein the control system is further configured to simultaneously feed the first metal stock to the inner-tube forming device, feed the second metal stock to the second-tube forming device, and feed the Nth metal stock to the Nth-tube forming device; and further wherein N is an integer greater than or equal to 3.

C26 The machine of paragraph C25, wherein the Nth metal supply includes at least one supply of Nth sheet metal.

C27 The machine of paragraph C26, wherein the at least one supply of Nth sheet metal includes at least one roll of Nth sheet metal.

C28 The machine of any of paragraphs C26-C27, wherein the Nth-tube forming device is configured to bend the Nth sheet metal to define at least one Nth-tube seam.

C29 The machine of paragraph C28, wherein the Nth-tube forming device includes an Nth-tube die.

C30 The machine of any of paragraphs C28-C29, further comprising:

an Nth-tube joining device positioned and configured to join the at least one Nth-tube seam to form at least one Nth-tube seal.

C31 The machine of paragraph C30, wherein the control system is further configured so that the Nth-tube joining device forms the at least one Nth-tube seal while the Nth metal stock is being fed to the Nth-tube forming device.

C32 The machine of any of paragraphs C30-C31, wherein the Nth-tube joining device is configured to weld the at least one Nth-tube seam to form the at least one Nth-tube seal.

C33 The machine of any of paragraphs C30-C32, further comprising:

an Nth-tube-seal inspecting device positioned and configured to inspect the at least one Nth-tube seal for quality.

C34 The machine of paragraph C33, wherein the control system is further configured so that the Nth-tube-seal inspecting device inspects the at least one Nth-tube seal for quality while a third metal stock is being fed to a third-tube forming device.

C35 The machine of any of paragraphs C26-C32, further comprising:

an Nth-sheet-metal coating device positioned and configured to apply a coating to at least one side of the Nth sheet metal.

C36 The machine of paragraph C35, wherein the control system is further configured so that the Nth-sheet-metal coating device applies the coating to the at least one side of the Nth sheet metal while the Nth metal stock is being fed to the Nth-tube forming device.

C37 The machine of any of paragraphs C35-C36, wherein the coating applied to at least one side of the Nth sheet metal includes one or more of a paint, an adhesive, a glue, a cement, an epoxy, a lubricant, a polymeric, a thermal insulating material, an electrical insulating material, a material adapted to distribute stress, and a material adapted to protect against corrosion.

C38 The machine of any of paragraphs C-C37, further comprising:

an inner-tube coating device positioned and configured to apply a coating to at least one of an inside and an outside of the inner metal tube.

C39 The machine of paragraph C38, wherein the control system is further configured so that the inner-tube coating device applies the coating to the at least one of the inside and the outside of the inner metal tube while the first metal stock is being fed to the inner-tube forming device.

C40 The machine of any of paragraphs C38-C39, wherein the coating applied to at least one of the inside and the outside of the inner metal tube includes one or more of a paint, an adhesive, a glue, a cement, an epoxy, a lubricant, a polymeric, a thermal insulating material, an electrical insulating material, a material adapted to distribute stress, and a material adapted to protect against corrosion.

C41 The machine of any of paragraphs C-C40, further comprising:

a second-tube coating device positioned and configured to apply a coating to at least one of an inside and an outside of the second metal tube.

C42 The machine of paragraph C41, wherein the control system is further configured so that the second-tube coating device applies the coating to the at least one of the inside and the outside of the second metal tube while the second metal stock is being fed to the second-tube forming device.

C43 The machine of any of paragraphs C41-C42, wherein the coating applied to at least one of the inside and the outside of the second metal tube includes one or more of a paint, an adhesive, a glue, a cement, an epoxy, a lubricant, a polymeric, a thermal insulating material, an electrical insulating material, a material adapted to distribute stress, and a material adapted to protect against corrosion.

C44 The machine of any of paragraphs C25-C43, further comprising:

a third-tube coating device positioned and configured to apply a coating to at least one of an inside and an outside of a third metal tube.

C45 The machine of paragraph C44, wherein the control system is further configured so that the third-tube coating device applies the coating to the at least one of the inside and the outside of the third metal tube while a third metal stock is being fed to a third-tube forming device.

C46 The machine of any of paragraphs C44-C45, wherein the coating applied to at least one of the inside and the outside of the third metal tube includes one or more of a paint, an adhesive, a glue, a cement, an epoxy, a lubricant, a polymeric, a thermal insulating material, an electrical insulating material, a material adapted to distribute stress, and a material adapted to protect against corrosion.

C47 The machine of any of paragraphs C25-C46, further comprising:

an Nth-tube coating device positioned and configured to apply a coating to at least one of an inside and an outside of the Nth metal tube.

C48 The machine of paragraph C47, wherein the control system is further configured so that the Nth-tube coating device applies the coating to the at least one of the inside and the outside of the Nth metal tube while the Nth metal stock is being fed to the Nth-tube forming device.

C49 The machine of any of paragraphs C47-C48, wherein the coating applied to at least one of the inside and the outside of the Nth metal tube includes one or more of a paint, an adhesive, a glue, a cement, an epoxy, a lubricant, a polymeric, a thermal insulating material, an electrical insulating material, a material adapted to distribute stress, and a material adapted to protect against corrosion.

C50 The machine of any of paragraph C-C49, further comprising:

an intermediate-layer positioning device positioned and configured to position an intermediate material between the inner metal tube and the second metal tube, and/or between the second metal tube and the third metal tube (when present), and/or between the Nth metal tube (when present) and the (N−1)th metal tube (when present).

C51 The machine of paragraph C50, wherein the intermediate material positioned between the inner metal tube and the second metal tube includes one or more of a paint, an adhesive, a glue, a cement, an epoxy, a lubricant, a polymeric, a thermal insulating material, an electrical insulating material, a material adapted to distribute stress, and a material adapted to protect against corrosion.

C52 The machine of any of paragraphs C50-C51, wherein the intermediate layer is non-metallic.

C53 The machine of any of paragraphs C50-C52, wherein the control system is further configured so that the intermediate-layer positioning device positions the intermediate material while the first metal stock is being fed to the inner-tube forming device.

C54 The machine of any of paragraphs C-C52, wherein the multi-layered pipe has an outer diameter between about 150 mm and about 1000 mm.

C55 The machine of any of paragraphs C-C52, wherein the multi-layered pipe has an outer diameter greater than 150 mm.

C56 The machine of any of paragraphs C-C52, wherein the multi-layered pipe has an outer diameter greater than 200 mm.

C57 The machine of any of paragraphs C-C52, wherein the multi-layered pipe has an outer diameter greater than 300 mm.

C58 The machine of any of paragraphs C-C52, wherein the multi-layered pipe has an outer diameter greater than 450 mm.

C59 The machine of any of paragraphs C-C52, wherein the multi-layered pipe has an outer diameter greater than 600 mm.

C60 The machine of any of paragraphs C-C59, wherein the multi-layered pipe has a thickness between about 10 mm and about 40 mm.

C61 The machine of any of paragraphs C-C59, wherein the multi-layered pipe has a thickness greater than 10 mm.

C62 The machine of any of paragraphs C-C59, wherein the multi-layered pipe has a thickness greater than 15 mm.

C63 The machine of any of paragraphs C-C59, wherein the multi-layered pipe has a thickness greater than 25 mm.

C64 The machine of any of paragraphs C-C59, wherein the multi-layered pipe has a thickness greater than 35 mm.

C65 The machine of any of paragraphs C-C64, wherein one or more of the inner metal tube, the second metal tube, the third metal tube (when present), and the Nth metal tube (when present) has a thickness between about 3 mm and about 20 mm.

C66 The machine of any of paragraphs C-C64, wherein one or more of the inner metal tube, the second metal tube, the third metal tube (when present), and the Nth metal tube (when present) has a thickness less than 5 mm.

C67 The machine of any of paragraphs C-C64, wherein one or more of the inner metal tube, the second metal tube, the third metal tube (when present), and the Nth metal tube (when present) has a thickness less than 10 mm.

C68 The machine of any of paragraphs C-C64, wherein one or more of the inner metal tube, the second metal tube, the third metal tube (when present), and the Nth metal tube (when present) has a thickness less than 25 mm.

C69 The machine of any of paragraphs C-C64, wherein one or more of the inner metal tube, the second metal tube, the third metal tube (when present), and the Nth metal tube (when present) has a thickness between about 3 mm and about 7 mm.

C70 The machine of any of paragraphs C-C69, wherein the machine is configured to form a multi-layered pipe having a length of at least 10 m.

C71 The machine of any of paragraphs C-C69, wherein the machine is configured to form a multi-layered pipe having a length of at least 30 m.

C72 The machine of any of paragraphs C-C69, wherein the machine is configured to form a multi-layered pipe having a length of at least 50 m.

C73 The machine of any of paragraphs C-C69, wherein the machine is configured to form a multi-layered pipe having a length of at least 100 m.

C74 The machine of any of paragraphs C-C69, wherein the machine is configured to form a multi-layered pipe having a length of at least 200 m.

C75 The machine of any of paragraphs C-C69, wherein the machine is configured to form a multi-layered pipe having a length of at least 300 m.

C76 The machine of any of paragraphs C-C69, wherein the machine is configured to form a multi-layered pipe having a length of at least 100 times an outer diameter of the multi-layered pipe.

C77 The machine of any of paragraphs C-C76, wherein the machine is configured to form a multi-layered pipe configured to withstand an internal pressure of at least 3.45 MPa.

C78 The machine of any of paragraphs C-C76, wherein the machine is configured to form a multi-layered pipe configured to withstand an internal pressure of at least 6.89 MPa.

C79 The machine of any of paragraphs C-C76, wherein the machine is configured to form a multi-layered pipe configured to withstand an internal pressure of at least 10.3 MPa, optionally wherein the multi-layered pipe is configured to withstand an internal pressure of at least 20.7 MPa, optionally wherein the multi-layered pipe is configured to withstand an internal pressure of at least 34.5 MPa, and further optionally wherein the multi-layered pipe is configured to withstand an internal pressure of at least 68.9 MPa.

C80 The machine of any of paragraphs C-C79, wherein the machine is positioned at least proximate to an installation site for a multi-layered pipe formed by the machine, and optionally wherein the installation site is a hydrocarbon industry installation site.

C81 The machine of paragraph C80, wherein the machine is positioned within 100 km of the installation site.

C82 The machine of paragraph C80, wherein the machine is positioned within 50 km of the installation site.

C83 The machine of paragraph C80, wherein the machine is positioned within 25 km of the installation site.

C84 The machine of paragraph C80, wherein the machine is positioned within 10 km of the installation site.

C85 The machine of paragraph C80, wherein the machine is positioned within 5 km of the installation site.

C86 The machine of paragraph C80, wherein the machine is positioned within 1 km of the installation site.

C87 The machine of paragraph C80, wherein the machine is positioned within 0.5 km of the installation site.

C88 The machine of paragraph C80, wherein the machine is positioned within 0.1 km of the installation site.

C89 The machine of any of paragraphs C-C88, wherein the machine is positioned proximate to a hydrocarbon extraction site.

C90 The machine of any of paragraphs C-C89, wherein the machine is positioned proximate to a wellbore associated with a hydrocarbon extraction site.

C91 The machine of any of paragraphs C-C90, wherein the machine is positioned proximate to a drilling site for hydrocarbons.

C92 The machine of any of paragraphs C-C91, wherein the machine is configured to position a multi-layered pipe formed by the machine into a wellbore associated with a hydrocarbon extraction site.

C93 The machine of any of paragraphs C-C92, wherein the inner-tube forming device and the second-tube forming device are coupled to a vehicle.

C94 The machine of paragraph C93, wherein the vehicle is a land-based vehicle.

C95 The machine of paragraph C93, wherein the vehicle is a marine-based vehicle.

C96 The machine of any of paragraphs C93-C95 in combination with the vehicle.

C97 The combination of the machine and the vehicle of paragraph C96, wherein the control system is further configured so that the vehicle translates relative to a ground surface and so that the multi-layered pipe is fed from the vehicle as it is formed.

C98 The combination of the machine and the vehicle of paragraph C97, wherein the control system is further configured so that a rate at which the vehicle translates relative to the ground surface is equal to a rate at which the multi-layered pipe is fed from the vehicle so that the multi-layered pipe is positioned on the ground surface and at least initially does not translate relative to the ground surface.

C99 The machine of any of paragraphs C-C98, wherein the inner-tube forming device is configured to form at least one inner-tube seam; and wherein the second-tube forming device is configured to form at least one second-tube seam that is radially offset from the at least one inner-tube seam.

C100 The machine of paragraph C99, wherein the third-tube forming device (when present) is configured to form at least one third-tube seam that is radially offset from the at least one second-tube seam.

C101 The machine of any of paragraphs C25-C100, wherein the Nth-tube forming device is configured to form at least one Nth-tube seam that is radially offset from an (N−1) th-tube seam.

C102 The machine of any of paragraphs C-C101, wherein the supply includes at least a first metal supply of the first metal stock and a second metal supply of the second metal stock.

C103 The machine of any of paragraphs C25-C37, wherein the supply includes an Nth metal supply of the Nth metal stock.

C104 The machine of any of paragraphs C1-C103, wherein the multi-layered pipe is for use in the hydrocarbon industry, such as in the extraction and/or transportation of hydrocarbons.

D The use of the machine of any of paragraphs C-C104 to form a multi-layered pipe.

D1 Multi-layered pipe formed by the machine of any of paragraphs C-C104.

D2 Multi-layered pipe formed by the use of the machine of any of paragraphs C-C104.

D3 The multi-layered pipe of any of paragraphs D-D2, wherein the multi-layered pipe is for use in the hydrocarbon industry, such as in the extraction and/or transportation of hydrocarbons.

D4 The use of the multi-layered pipe of any of paragraphs D1-D3 in the hydrocarbon industry, such as in the extraction and/or transportation of hydrocarbons.

E A method of forming a multi-layered pipe, wherein the multi-layered pipe has an inner metal tube and an outer metal tube and wherein the multi-layered pipe has a first longitudinal section and a second longitudinal section spaced from the first longitudinal section, the method comprising:

forming the inner metal tube of the first longitudinal section;

after forming the inner metal tube of the first longitudinal section, forming the inner metal tube of the second longitudinal section;

while forming the inner metal tube of the second longitudinal section, forming the outer metal tube of the first longitudinal section around the inner metal tube of the first longitudinal section; and after forming the outer metal tube of the first longitudinal section around the inner metal tube of the first longitudinal section, forming the outer metal tube of the second longitudinal section around the inner metal tube of the second longitudinal section.

E1 The method of paragraph E, wherein the multi-layered pipe is for use in the hydrocarbon industry, such as in the extraction and/or transportation of hydrocarbons.

E2 A multi-layered pipe formed by the method of paragraph E.

E3 The use of the multi-layered pipe of paragraph E2 in the hydrocarbon industry, such as in the extraction and/or transportation of hydrocarbons.

INDUSTRIAL APPLICABILITY

The methods, multi-layered pipes, and machines according to the present disclosure are applicable to the pipelining industry, especially with regard to the hydrocarbon industry.

In the event that any of the references that are incorporated by reference herein define a term in a manner or are otherwise inconsistent with either the non-incorporated disclosure of the present application or with any of the other incorporated references, the non-incorporated disclosure of the present application shall control, and the term or terms as used therein only control with respect to the patent document in which the term or terms are defined.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B", when used in conjunction with open-ended language such as "comprising" can refer, in one embodiment, to A only (optionally including entities, other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" may mean A alone, B alone, C alone, A and B together, A and C together, B and C together, A, B and C together, and optionally any of the above in combination with at least one other entity.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

I claim:

1. A method for forming a multi-layered pipe for extraction or transportation of hydrocarbons comprising:

feeding a first metal stock, from a first metal supply, into a first tube forming device, wherein the first metal supply includes at least one supply of first sheet metal;

forming, with the first tube forming device, an inner metal tube with the first metal stock by bending the first sheet metal to define at least one inner-tube seam and joining the at least one inner-tube seam to form at least one inner-tube seal; and while the first tube forming device forms the inner metal tube, feeding a second metal stock, from a second metal supply different from the first metal supply, into a second tube forming device, wherein the second metal supply includes at least one supply of second sheet metal; and forming a second metal tube, from the second metal stock fed into the second tube forming device, around the inner metal tube by bending the second sheet metal to define at least one second-tube seam and joining the at least one second-tube seam to form at least one second-tube seal, wherein the inner metal tube and second metal tube form the multi-layered pipe configured for extraction or transportation of hydrocarbons, and wherein each at least one second-tube seal is radially offset from each at least one inner-tube seal.

2. The method of claim 1, wherein while forming the at least one inner-tube seal, the method includes forming at least one second-tube seal.

3. The method of claim 1, wherein at least one of the inner metal tube and the second metal tube is formed by joining at least two longitudinal seams to form a complete tube circumference.

4. The method of claim 3, wherein the inner metal tube has an outer surface, wherein the second metal tube has an inner surface, and further wherein the outer surface of the inner metal tube tightly rests against the inner surface of the second metal tube.

5. The method of claim 1, wherein the bending the first sheet metal includes feeding the first sheet metal through an inner-tube die, and wherein the bending the second sheet metal includes feeding the second sheet metal through a second-tube die.

6. The method of claim 1, further comprising:

while forming the inner metal tube, inspecting the at least one inner-tube seal and inspecting the at least one second-tube seal.

7. The method of claim 1, wherein the joining the at least one inner-tube seam includes welding the at least one inner-tube seam to form the at least one inner-tube seal, and wherein the joining the at least one second-tube seam includes welding the at least one second-tube seam to form the at least one second-tube seal.

8. The method of claim 1, further comprising:

while forming the inner metal tube, applying a coating to one or more of at least one side of the first sheet metal, at least one side of the second sheet metal, at least one of an inside and an outside of the first metal tube, and at least one of an inside and an outside of the second metal tube.

9. The method of claim 8, wherein the coating includes one or more of a paint, an adhesive, a glue, a cement, an epoxy, a lubricant, a polymeric, a thermal insulating material, an electrical insulating material, a material adapted to distribute stress, and a material adapted to protect against corrosion.

10. The method of claim 1, further comprising:

while forming the inner metal tube, forming a third metal tube around the second metal tube from a third metal stock fed from a third metal supply.

11. The method of claim 1, further comprising:

while forming the inner metal tube, positioning a preformed intermediate material between the inner metal tube and the second metal tube.

12. The method of claim 11, wherein the intermediate material between the inner metal tube and the second metal tube is non-metallic.

13. The method of claim 1, wherein the multi-layered pipe has an outer diameter greater than 150 mm.

14. The method of claim 1, wherein the multi-layered pipe has a thickness greater than 10 mm.

15. The method of claim 1, further comprising:

ceasing the forming of the inner metal tube and ceasing the forming of the second metal tube when a length of the multi-layered pipe is greater than or equal to a predetermined length, wherein the predetermined length is at least 100 times an outer diameter of the multi-layered pipe.

16. The method of claim 1, wherein the multi-layered pipe is configured to withstand an internal pressure of at least 3.45 MPa.

17. The method of claim 1, wherein the multi-layered pipe is formed proximate to an installation site for the multi-layered pipe.

18. The method of claim 17, wherein the method is performed within 1 km of the installation site.

19. The method of claim 1, wherein the forming the inner metal tube and the forming the second metal tube are performed on a vehicle.

20. The method of claim 19, further comprising:

translating the vehicle relative to a ground surface and feeding the multi-layered pipe from the vehicle to an installation site for the multi-layered pipe.

21. The method of claim 19, wherein the vehicle is a land-based vehicle.

22. The method of claim 19, wherein the vehicle is a marine-based vehicle.

23. The method of claim 1, wherein the first metal stock has a different composition than the second metal stock.

24. The method of claim 1, wherein the multi-layered pipe is configured to withstand an internal pressure of at least 6.89 MPa.

25. A method of forming a multi-layered pipe for use in the hydrocarbon industry, wherein the multi-layered pipe has an inner metal tube and an outer metal tube configured for extraction or transportation of hydrocarbons and wherein the multi-layered pipe has a first longitudinal section and a second longitudinal section spaced from the first longitudinal section, the method comprising:

forming the inner metal tube of the first longitudinal section with a first tube forming device;

after forming the inner metal tube of the first longitudinal section, forming the inner metal tube of the second longitudinal section with the first tube forming device which includes joining at least one inner-tube seam to form at least one inner-tube seal;

while forming the inner metal tube of the second longitudinal section, forming the outer metal tube of the first longitudinal section around the inner metal tube of the first longitudinal section with a second tube forming device, different from the first tube forming device; and after forming the outer metal tube of the first longitudinal section around the inner metal tube of the first longitudinal section, forming the outer metal tube of the second longitudinal section around the inner metal tube of the second longitudinal section with the second tube forming device which includes joining at least one outer-tube seam to form at least one outer-tube seal, wherein each at least one outer-tube seal is radially offset from each at least one inner-tube seal.

26. The method of claim 25, wherein the multi-layered pipe is configured to withstand an internal pressure of at least 3.45 MPa.

27. The method of claim 25, wherein the joining the at least one inner-tube seam includes welding the at least one inner-tube seam to form the at least one inner-tube seal, and wherein the joining the at least one outer-tube seam includes welding the at least one outer-tube seam to form the at least one outer-tube seal.

28. The method of claim 25, wherein the inner metal tube has an outer surface, wherein the outer metal tube has an inner surface, and further wherein the outer surface of the inner metal tube tightly rests against the inner surface of the outer metal tube.

29. The method of claim 25, further comprising:

while forming the inner metal tube, applying a coating to one or more of at least one side of the inner metal tube, at least one side of the outer metal tube, at least one of an inside and an outside of the inner metal tube, and at least one of an inside and an outside of the outer metal tube.

30. The method of claim 29, wherein the coating includes one or more of a paint, an adhesive, a glue, a cement, an epoxy, a lubricant, a polymeric, a thermal insulating material, an electrical insulating material, a material adapted to distribute stress, and a material adapted to protect against corrosion.

31. The method of claim 25, further comprising:

while forming the inner metal tube, positioning a preformed intermediate material between the inner metal tube and the outer metal tube.

32. The method of claim 31, wherein the intermediate material between the inner metal tube and the outer metal tube is non-metallic.

33. The method of claim 25, further comprising:

ceasing the forming of the inner metal tube and ceasing the forming of the outer metal tube when a length of the multi-layered pipe is greater than or equal to a predetermined length, wherein the predetermined length is at least 100 times an outer diameter of the multi-layered pipe.

34. The method of claim 25, wherein the forming the inner metal tube and the forming the outer metal tube are performed on a vehicle.

* * * * *